US009738426B1

(12) United States Patent
Giraud et al.

(10) Patent No.: US 9,738,426 B1
(45) Date of Patent: Aug. 22, 2017

(54) FLAT PACK RAMP LEVER

(71) Applicants: Jean-Pierre Giraud, Auburn, AL (US); Herve Pichot, Chennevieres-sur-Marne (FR)

(72) Inventors: Jean-Pierre Giraud, Auburn, AL (US); Herve Pichot, Chennevieres-sur-Marne (FR)

(73) Assignee: CSP TECHNOLOGIES, INC., Auburn, AL (US)

( * ) Notice: Subject to any disclaimer, the term of this patent is extended or adjusted under 35 U.S.C. 154(b) by 0 days.

(21) Appl. No.: 14/189,852

(22) Filed: Feb. 25, 2014

Related U.S. Application Data

(60) Provisional application No. 61/769,393, filed on Feb. 26, 2013.

(51) Int. Cl.
*B65D 43/22* (2006.01)
*B65D 50/02* (2006.01)
*B65D 50/04* (2006.01)

(52) U.S. Cl.
CPC ..... *B65D 50/02* (2013.01); *B65D 43/22* (2013.01); *B65D 50/04* (2013.01); *B65D 2251/1016* (2013.01); *B65D 2251/1058* (2013.01)

(58) Field of Classification Search
CPC .. A45C 13/1084; A45D 40/22; A45D 33/006; B65D 2215/02; B65D 2215/04; B65D 2251/1025; B65D 50/04; B65D 43/22; B65D 43/163; B65D 2251/1016; B65D 2251/1058; Y10S 292/37; Y10S 292/38
USPC ..... 220/262, 263, 264, 324, 326, 833, 834, 220/835; 132/293; 292/DIG. 11
See application file for complete search history.

(56) References Cited

U.S. PATENT DOCUMENTS

| | | | | | |
|---|---|---|---|---|---|
| 4,170,315 | A | * | 10/1979 | Dubach | B65D 47/0814 220/281 |
| 4,387,730 | A | * | 6/1983 | Shioi | 132/301 |
| 4,972,860 | A | * | 11/1990 | Yuhara et al. | 132/301 |
| 5,908,037 | A | * | 6/1999 | Pierson | 132/293 |
| 5,911,937 | A | | 6/1999 | Hekal | |
| 6,080,350 | A | | 6/2000 | Hekal | |
| 6,124,006 | A | | 9/2000 | Hekal | |
| 6,130,263 | A | | 10/2000 | Hekal | |
| 6,174,952 | B1 | | 1/2001 | Hekal et al. | |
| 6,214,255 | B1 | | 4/2001 | Hekal | |
| 6,486,231 | B1 | | 11/2002 | Hekal | |
| 6,613,405 | B1 | | 9/2003 | Hekal | |

(Continued)

*Primary Examiner* — James N Smalley
(74) *Attorney, Agent, or Firm* — David B. Gomish; Eckert Seamans Cherin & Mellott, LLC

(57) ABSTRACT

A package comprises a latch including first and second legs and an actuating portion. The first and second legs are joined at an angle. The actuator portion of the first leg is positioned to be displaced generally laterally to displace the second leg generally longitudinally to release the latch. In another embodiment the package has base wells on the inside surface. A generally flat marginal sealing surface encircles the first and second base wells. The wells of the base and/or lid are covered with a cover sheet to close them. Still another embodiment is a child-resistant container comprising a shell, two drawers, a stop, and a latch. The drawers are prevented from sliding apart past a limit of travel when one drawer is open sufficiently to provide access to its contents and the other drawer is not.

16 Claims, 39 Drawing Sheets

(56) References Cited

U.S. PATENT DOCUMENTS

| | | | | |
|---|---|---|---|---|
| 7,005,459 | B2 | 2/2006 | Hekal | |
| 2007/0023317 | A1* | 2/2007 | Brozell | B65D 83/0463 206/538 |
| 2008/0308568 | A1* | 12/2008 | Grenier et al. | 220/810 |
| 2011/0067363 | A1* | 3/2011 | Sprada et al. | 53/492 |
| 2012/0055929 | A1* | 3/2012 | Hayton et al. | 220/324 |
| 2013/0082059 | A1* | 4/2013 | Huang | 220/281 |

* cited by examiner

FLAT PACK RAMP LEVER

CROSS REFERENCE TO RELATED APPLICATION

This application claims the benefit of U.S. Provisional Patent Application No. 61/769,393, filed Feb. 26, 2013 which is incorporated herein as if fully set forth.

BACKGROUND OF THE INVENTION

The present invention relates to a package, for example a child-resistant, elder friendly package to contain articles such as pharmaceutical dosage forms or tobacco products.

Containers provided with child safety features are well known in the art, particularly in North America, for packaging pharmaceutical products. The child safety feature is also referred to as a Child-Resistant Closure (CRC). In general, a child-resistant closure must be difficult for children under 5 years old to open, yet be generally user friendly for users over 50 years old, particularly for users over 60 years old. The US government has established a CR protocol to evaluate effectiveness of closures. Child-Resistant Protocol testing is defined under CFR Title 16, Part 1700 by the Food and Drug Administration. Ideally these are provided in a way that is easy and convenient for the intended consumer to use the product.

Product packaging enhances a product with many additional features such as environmental protection and protection from being damaged. Many products are packaged in multiple unit packages or bulk for consumer convenience and packaging efficiency. Typically the entire product is exposed when the package is opened. If the product needs to be protected from the environment, for example humidity, then a seal is required.

One way to ensure the product is protected is to provide a seal for the entire contents of the package. This type of approach may impose certain dimensional, shape or other design constraints on the package design. In this approach, all of the product may be exposed to the consumer or child who opens the package. Some means would be needed to restrain the product so that it is held in place so that it is easy to access but does not fall out of the package.

Another way is to protect the product in a protective envelope or wrapper. When this wrapper is opened, the entire product is exposed. Again, the entire product is exposed to the environment and it is no longer protected. In addition, the entire remaining product is exposed to children.

Depending on the requirements of the package, the design may become complicated with several contradictory constraints that would need to be managed in order to meet the requirements. This could lead to added expense and an undesirable package for the consumer.

BRIEF SUMMARY OF THE INVENTION

What is desirable is a simple, easy to configure package that can accommodate different types of products and packaging requirements.

An aspect of the invention is a package comprising a first shell portion, a second shell portion, optionally a hinge, and a latch.

The first shell portion has a first peripheral portion and a second peripheral portion. The second shell portion has a first peripheral portion and a second peripheral portion. The second peripheral portion of the second shell includes a first latching abutment.

Optionally, but not essentially or necessarily, a hinge can be provided that joins the first shell portion and second shell portion at their first peripheral portions.

The latch is configured for releasably latching the second peripheral portions of the first shell portion and second shell portion together. The latch includes first and second legs, an actuating portion, and a second latching abutment. The first and second legs are joined at an angle. The first leg is secured to the first shell portion.

The first leg has an actuator portion and the second leg has a second latching abutment. The actuator portion of the first leg is positioned to be displaced, for example, generally laterally, by a user's finger to displace the second leg, for example, generally longitudinally, from a latched position to a released position. The second latching abutment is secured to the second leg. The second latching abutment is configured to engage the first latching abutment when the second leg is in its latched position and to release the first latching abutment when the second leg is in its released position.

Another embodiment of the invention is a clamshell package including a base shell, a lid shell, an integral hinge, and a closure.

The base shell has inside and outside surfaces. It has at least a first and second base well on the inside surface. A generally flat marginal sealing surface encircles the first and second base wells. The lid shell also has inside and outside surfaces. It optionally has at least first and second base lid wells on the inside surface. A generally flat marginal sealing surface encircles the first and second lid wells.

The integral hinge joins the base shell and lid shell. The hinge allows the base shell and lid shell to close together in clamshell fashion. When the clamshell package is closed, the marginal sealing surfaces of the lid shell and base shell are facing and adjacent to each other, preventing access to the wells. The closure releasably secures the base shell to the lid shell when closed.

According to another exemplary embodiment of the invention the base shell further comprises at least a second base well on the inside surface.

According to another exemplary embodiment of the invention the generally flat marginal sealing surface of the base shell encircles the base wells.

According to another exemplary embodiment of the invention the lid shell comprises at least a first lid well on the inside surface and a generally flat marginal sealing surface of the lid shell encircling the first lid well.

According to another exemplary embodiment of the invention the lid shell further comprises at least a second lid well on the inside surface of the lid shell.

According to another exemplary embodiment of the invention the generally flat marginal sealing surfaces of the lid shell encircle the lid wells.

According to another exemplary embodiment of the invention, the package further comprises a sealing sheet adhered to the generally flat marginal sealing surfaces of the base wells to hermetically seal the individual base wells.

According to another exemplary embodiment of the invention, package further comprises a sealing sheet adhered to the generally flat marginal sealing surfaces encircling the lid wells to hermetically seal the individual lid wells.

According to another exemplary embodiment of the invention the sealing sheet is weakened or cut between adjacent wells to define separately removable strips that can be individually removed to unseal one well without unsealing an adjacent well.

According to another exemplary embodiment of the invention the base shell, lid shell, integral hinge, and closure are formed as a single injection molded part.

According to another exemplary embodiment of the invention, package further comprises at least a third base well on the inside surface of the base shell, in which the generally flat marginal sealing surface of the base shell encircles the third well.

According to another exemplary embodiment of the invention, package further comprises at least a third lid well on the inside surface of the lid shell, in which the generally flat marginal sealing surface of the lid shell encircles the third lid well.

According to another exemplary embodiment of the invention the first closure comprises at least a first upward-facing lid abutment secured to the lid shell and at least a first downward-facing base abutment secured to the base shell and normally bearing against the lid abutment when the package is closed.

According to another exemplary embodiment of the invention, the package further comprises a second closure comprising at least a second upward-facing lid abutment secured to the lid shell and at least a second downward-facing base abutment secured to the base shell and normally bearing against the lid abutment when the package is closed.

According to another exemplary embodiment of the invention, the first closure is spaced from the second closure.

According to another exemplary embodiment of the invention, at least one first abutment is resiliently mounted to the corresponding shell, normally biased to engage the other first abutment, and resiliently deflectable against its bias to disengage the other first abutment, releasing the first closure.

According to another exemplary embodiment of the invention, at least one of the second abutments is resiliently mounted to the corresponding shell, normally biased to engage the other second abutment, and resiliently deflectable against its bias to disengage the other second abutment, releasing the second closure.

According to another exemplary embodiment of the invention, the first and second closures must be operated at least substantially simultaneously to open the package.

According to another exemplary embodiment of the invention, the resiliently mounted abutments of the first and second closures are operable to release the closures by urging the resiliently mounted abutment of one closure toward the resiliently mounted abutment of another closure.

According to another exemplary embodiment of the invention, the base and lid wells have a length and width generally parallel to the generally flat marginal sealing surface of the base shell and a depth generally perpendicular to the generally flat marginal sealing surface of the base shell.

According to another exemplary embodiment of the invention, the base and lid wells lengths at least three times as great as their widths.

According to another exemplary embodiment of the invention, the package further comprises a dosage form of a product in at least one of the base or lid wells.

According to another exemplary embodiment of the invention, the dosage form is an extruded stick of a composition.

According to another exemplary embodiment of the invention, the dosage form is a rolled sheet of a composition.

According to another exemplary embodiment of the invention, the sheet of a composition comprises a portion of a leaf.

According to another exemplary embodiment of the invention, the composition comprises ground material and a binding agent.

According to another exemplary embodiment of the invention, a base well or lid well is defined by an upstanding wall extending from the corresponding shell to the generally flat marginal sealing surface and encircling the well.

According to another exemplary embodiment of the invention, the upstanding walls of at least two adjacent base wells or lid wells are spaced apart, defining a gap between them.

According to another exemplary embodiment of the invention, a base well or lid well is formed by a corrugation in the corresponding base shell or lid shell.

According to another exemplary embodiment of the invention, a base well or lid well is formed by a depression in the corresponding base shell or lid shell.

According to another exemplary embodiment of the invention, the base wells and lid wells reinforce the base shell and lid shell against deformation.

According to another exemplary embodiment of the invention, the moisture ingress does not exceed 2500 micrograms per day of water when closed.

According to another exemplary embodiment of the invention, the sealed wells have a moisture ingress rate that does not exceed 750 micrograms per day of water.

According to another exemplary embodiment of the invention, the thinnest portions of the base shell and the lid shell are each at least 0.5 mm thick.

According to another exemplary embodiment of the invention, the thinnest portions of the base shell and the lid shell are each at least 0.8 mm thick.

According to another exemplary embodiment of the invention, the thinnest portions of the base shell and the lid shell are each at least 1 mm thick.

According to another exemplary embodiment of the invention, the thinnest portions of the base shell and the lid shell are each at least 2 mm thick.

According to another exemplary embodiment of the invention the package further comprises a peripheral seal disposed around the wells of the base shell and lid shell.

According to another exemplary embodiment of the invention the package further comprises a re-sealable peripheral seal disposed around the wells of the base shell and lid shell.

According to another exemplary embodiment of the invention the package incorporates an active agent entrained plastic to remove gases.

According to another exemplary embodiment of the invention the active agent is an oxygen absorber.

According to another exemplary embodiment of the invention the active agent is a desiccant.

According to another exemplary embodiment of the invention the active agent is a molecular sieve or silica gel.

An embodiment of another aspect of the invention is a method of filling the package with a product. Pieces of the product are placed in the base and/or lid wells. The wells of the base and/or lid are covered with a cover sheet to close them. The cover sheet is sealed to the generally flat marginal sealing surfaces to seal the wells. Portions of the cover sheet between two wells are weakened or cut to form strips of the cover sheet. In an embodiment, each strip of the cover sheet covers one well. In an embodiment, each strip is removable separately from one or more adjacent strips of the cover sheet covering different wells.

Still another embodiment is child-resistant container comprising a shell, two drawers, a stop, and a latch.

The shell optionally can have opposed first and second drawer openings. The shell can define a longitudinal passage from the first drawer opening to the second drawer opening.

A first drawer is slidably received in the longitudinal passage and projects through the first drawer opening when the first drawer is opened. A second drawer is slidably received in the longitudinal passage, relatively movable with respect to the first drawer, and projects through the second drawer opening when the second drawer is opened.

The stop is located within the passage. It is configured to engage the first and second drawers to prevent the first and second drawers from sliding apart past a limit of travel, with respect to the shell. The limit of travel is reached when either of the first and second drawers is open sufficiently to provide access to its contents and the other drawer is closed sufficiently to prevent access to its contents.

The latch is normally biased to latch the first and second drawers closed. The latch is operable against its normal bias to unlatch at least one drawer.

According to another exemplary embodiment of the invention, the stop comprises an abutment of the first drawer facing the first opening and an abutment of the second drawer facing the second opening, the first and second abutments engaging to define the stop when the drawers are moved apart.

According to another exemplary embodiment of the invention at least one of the abutments is connected to the corresponding drawer by a link extending toward the other drawer.

According to another exemplary embodiment of the invention each of the abutments is connected to the corresponding drawer by a link extending toward the other drawer.

According to another exemplary embodiment of the invention each drawer is identical in shape.

According to another exemplary embodiment of the invention the shell further defines a side opening providing access to the longitudinal passage from outside the shell.

According to another exemplary embodiment of the invention the latch is at least partially within the longitudinal passage and accessible through the side opening for unlatching a drawer.

According to another exemplary embodiment of the invention the latch comprises a first latch engaging the first drawer and a second latch engaging the second drawer.

According to another exemplary embodiment of the invention the shell further defines first and second side openings providing access to the longitudinal passage from outside the shell.

According to another exemplary embodiment of the invention first and second latches are at least partially within the longitudinal passage and respectively accessible through the first and second side openings, respectively for unlatching the first and second drawers.

According to another exemplary embodiment of the invention the first drawer has a first drawer abutment facing the first drawer opening, the latch has a first latch abutment facing the second drawer opening, and the first drawer abutment and first latch abutment are positioned to engage each other when the first drawer is closed and the latch is normally biased to latch the first drawer closed.

According to another exemplary embodiment of the invention the second drawer has a second drawer abutment facing the first drawer opening, the latch has a second latch abutment facing the second side opening, and the second drawer abutment and second latch abutment are positioned to engage each other when the first drawer is closed and the latch is normally biased to latch the first drawer closed.

According to another exemplary embodiment of the invention the first and second latches are configured to unlatch by traveling transversely in opposite directions within the passage, disengaging one of the first and second drawer abutments from the corresponding latch abutment when both latches are operated.

According to another exemplary embodiment of the invention the first drawer and the latch are configured to unlatch the first drawer only when both pushing the first drawer further closed to engage an unlatching mechanism and operating the latch to unlatch the first drawer.

According to another exemplary embodiment of the invention the second drawer and the latch are configured to unlatch the second drawer only when both pushing the second drawer further closed to engage a second unlatching mechanism and operating the latch to unlatch the second drawer.

According to another exemplary embodiment of the invention the unlatching mechanism is a ramp on the latch and a ramp on a link projecting from the drawer that engage to deflect the drawer abutment transversely away from the latch abutment.

According to another exemplary embodiment of the invention the ramp on the latch and the corresponding ramp on the drawer are normally longitudinally displaced when the drawer is closed, and are longitudinally aligned in engaging relation when the drawer is pushed further closed.

According to another exemplary embodiment of the invention, the container further comprises a stop preventing the drawers from being simultaneously pushed further closed sufficiently to engage both the unlatching mechanism of the first drawer and the unlatching mechanism of the second drawer, thereby only allowing one of the first and second drawers to be opened at a time.

According to another exemplary embodiment of the invention the first and second latch are identical in shape.

According to another aspect of the invention, a package includes a first shell portion having a base sidewall, a second shell portion having at least one catch and at least one lid ramp, and, optionally, a hinge joining the first shell portion and second shell. Additionally, the package includes at least one latch for releasably latching the first shell portion and second shell portion together. The at least one latch has an actuator portion adapted to be displaced by a user to release the latch. The latch also includes a latch ramp, the latch ramp configured to engage the lid ramp when the actuator is displaced to raise and unlatch second shell portion.

Another aspect of the invention is a package comprising a first shell portion having a base sidewall, a second shell portion having at least one catch, and, optionally, a hinge joining the first shell portion and second shell. The package also includes a latch for releasably latching the first shell portion and second shell portion together. The latch has an end portion and an actuator portion. The actuator portion is adapted to be displaced by a user to release the latch. The package further includes a button assembly, the button assembly including a button, a tab, and a cavity. The button assembly is adapted to be displaced from a closed position to a locked position. The tab is positioned to be adjacent to the end portion of the latch when the button assembly is in the closed position to prevent the displacement of the latch. The button assembly is configured to align the cavity with the end portion of the latch when the button assembly is in an open position to allow the displacement of the latch.

Figure 1:
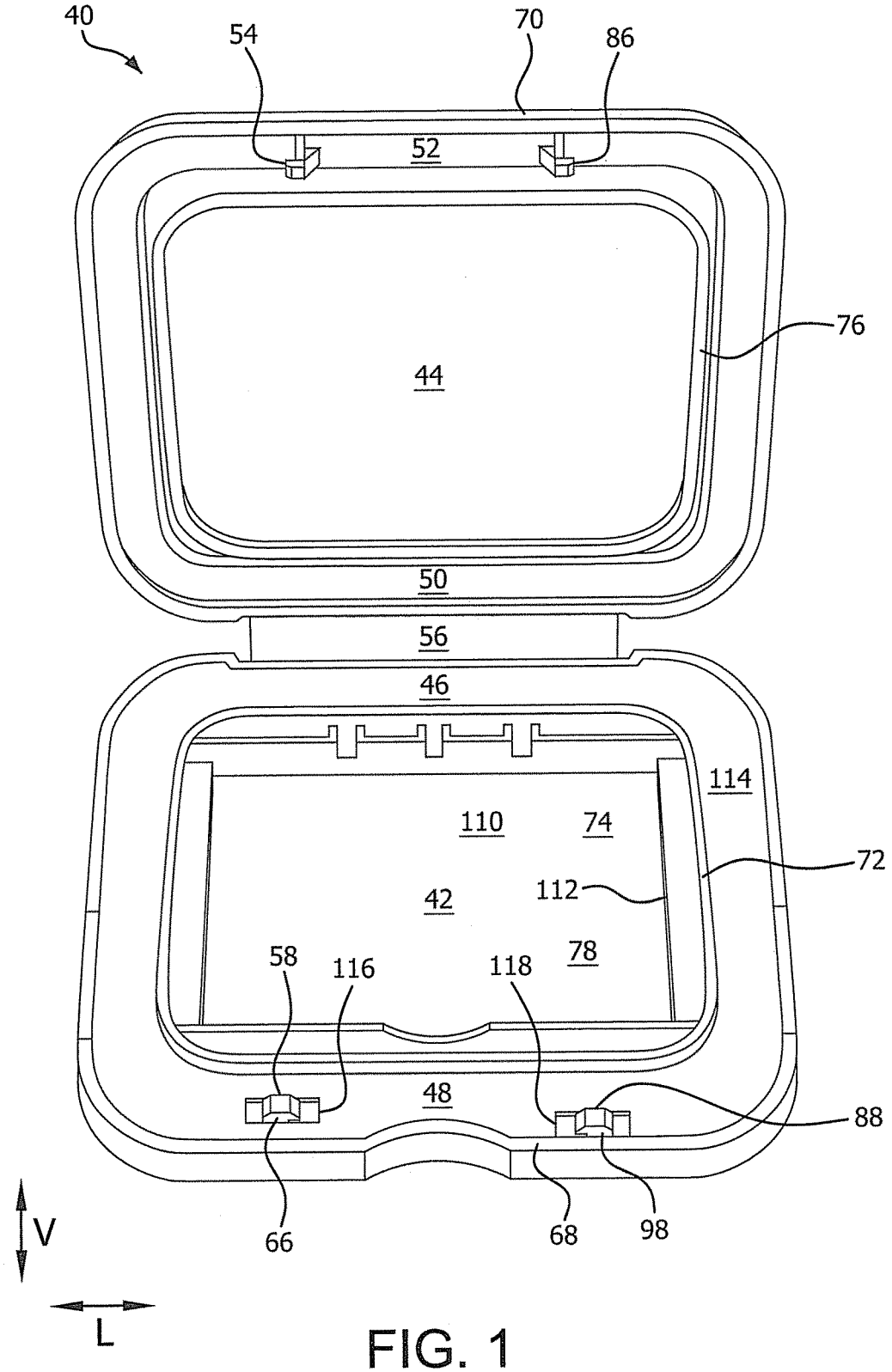
FIG. 1 is a perspective view of an embodiment of the package assembly, showing the lid open to show the interior.

The following reference characters are used in the specification and figures:

| | |
|---|---|
| 40 | package |
| 42 | First shell portion |
| 44 | Second shell portion |
| 46 | First peripheral portion (of 42) |
| 48 | Second peripheral portion (of 42) |
| 50 | First peripheral portion (of 44) |
| 52 | Second peripheral portion (of 44) |
| 54 | First latching abutment |
| 56 | Hinge |
| 58 | Latch |
| 60 | First leg (of 58) |
| 62 | Second leg (of 58) |
| 64 | Actuator portion (of 60) |
| 66 | Second latching abutment |
| 68 | Peripheral edge (of 42) |
| 70 | Peripheral edge (of 44) |
| 72 | First closed lip |
| 74 | Enclosure (defined by 72) |
| 76 | Second closed lip |
| 78 | Insert |
| 80 | First bending ramp (for 62) |
| 82 | First biasing abutment (for 62) |
| 84 | First pivot (of 60) |
| 86 | Third latching abutment |
| 88 | Second latch |
| 90 | Third leg |
| 92 | Fourth leg |

-continued

| | |
|---|---|
| 94 | Actuator portion (of 90) |
| 96 | Second bending ramp (engaged by 92) |
| 98 | Fourth latching abutment |
| 100 | Second biasing abutment (for 92) |
| 102 | Second pivot (of 90) |
| 104 | Remainder of 42 (other than insert 78) |
| 106 | Leaf spring (of 60) |
| 108 | Leaf spring (of 90) |
| 110 | Recess |
| 112 | Sidewall (of 110) |
| 114 | Flange |
| 116 | Aperture (in 114) |
| 118 | Aperture (in 114) |
| 120 | package |
| 122 | Base shell |
| 124 | Lid shell |
| 126 | Integral hinge |
| 128 | First closure detent |
| 129 | First closure aperture |
| 130 | Second closure detent |
| 131 | Second closure aperture |
| 132 | Inside surface (of 22) |
| 134 | Outside surface (of 22) |
| 136 | Base well (of 22) |
| 138 | Base well (of 22) |
| 140 | Base well (of 22) |
| 142 | Base well (of 22) |
| 144 | Base well (of 22) |
| 146 | Long upstanding wall (of 36) |
| 148 | Long upstanding wall (of 38) |
| 150 | Gap (between 46 and 48) |
| 152 | Short upstanding wall (of 36) |
| 154 | Short upstanding wall (of 38) |
| 156 | Marginal sealing surface (of 36) |
| 158 | Marginal sealing surface (of 38) |
| 160 | Marginal sealing surface (of 40) |
| 162 | Marginal sealing surface (of 42) |
| 164 | Marginal sealing surface (of 44) |
| 166 | Long upstanding wall (of 38) |
| 168 | Long Corrugation |
| 172 | Inside surface (of 24) |
| 174 | Outside surface (of 24) |
| 176 | Base wall (of 24) |
| 178 | Base wall (of 24) |
| 180 | Base wall (of 24) |
| 182 | Base wall (of 24) |
| 184 | Base wall (of 24) |
| 186 | Long upstanding wall (of 76) |
| 188 | Long upstanding wall (of 78) |
| 190 | Gap (between 86 and 88) |
| 192 | Short upstanding wall (of 76) |
| 194 | Short upstanding wall (of 76) |
| 196 | Marginal sealing surface (of 76) |
| 198 | Marginal sealing surface (of 78) |
| 200 | Marginal sealing surface (of 80) |
| 202 | Marginal sealing surface (of 82) |
| 204 | Marginal sealing surface (of 84) |
| 206 | Long upstanding wall (of 78) |
| 210 | Upward lid abutment |
| 212 | Downward base abutment |
| 214 | Resilient tab (for 28) |
| 216 | Provisional portion (of 44) |
| 218 | Distal portion (of 44) |
| 220 | Upward lid abutment |
| 222 | Resilient tab |
| 224 | Proximal part (of 122) |
| 226 | Distal part (of 122) |
| 228 | Thumb tab |
| 230 | Sealing sheet |
| 232 | Sealing sheet |
| 234 | Cut (of 130) |
| 236 | Cut (of 130) |
| 238 | Cut (of 130) |
| 240 | Cut (of 130) |
| 242 | Cut (of 132) |
| 244 | Cut (of 132) |
| 246 | Cut (of 132) |
| 248 | Cut (of 132) |
| 250 | Product piece |

-continued

| | |
|---|---|
| 252 | Product piece |
| 254 | Product piece |
| 256 | Product piece |
| 258 | Product piece |
| 260 | Product piece |
| 262 | Product piece |
| 264 | Product piece |
| 266 | Product piece |
| 268 | Product piece |
| 270 | Strip |
| 272 | Well |
| 274 | Lid shell |
| 276 | Base shell |
| 280 | Base shell (FIG. 12) |
| 282 | Lid shell (FIG. 13) |
| 283 | Perimeter seal |
| 284 | Lip (of 180) |
| 286 | Lip (of 182) |
| 290 | Base shell |
| 292 | Lid shell |
| 294 | Blister sheet (of 190) |
| 296 | Blister sheet (of 192) |
| 298 | Cover sheet (of 190) |
| 300 | Cover sheet (of 192) |
| 330 | Container |
| 332 | Shell |
| 334 | First drawer |
| 336 | Second drawer |
| 338 | First abutment (of stop) |
| 340 | Second abutment (of stop) |
| 342 | First latch |
| 344 | Second latch |
| 346 | First drawer opening |
| 348 | Second drawer opening |
| 350 | Passage (of 30) |
| 352 | First side opening (of 30) |
| 354 | Second side opening (of 30) |
| 356 | Gasket (of 34) |
| 358 | Storage area (of 34) |
| 360 | First link (of 34) |
| 362 | Second link |
| 364 | First push button gasket |
| 366 | Second push button gasket |
| 368 | First latch abutment (of 42) |
| 370 | Ramp (of drawer 42) |
| 372 | Ramp (of drawer 42) |
| 374 | Second latch abutment (of 44) |
| 376 | Push button (of 42) |
| 378 | Push button (of 44) |
| 380 | First unlatching mechanism |
| 382 | Second unlatching mechanism |
| 384 | Ramp (of drawer 34) |
| 386 | Ramp (of drawer 34) |
| 388 | Link (of drawer 34) |
| 390 | First drawer abutment (of 34) |
| 392 | Second drawer abutment (of 36) |
| 394 | First stop (in drawer 34) |
| 396 | Second stop (in drawer 36) |
| 398 | Second link (of drawer 34) |
| 400 | Guide (of 32) |
| 402 | Guide (of 32) |
| 404 | Guide (of 32) |
| 406 | Guide (of 32) |
| 408 | Guide (of 32) |
| 410 | Guide (of 32) |
| 412 | Cover (of 34) |
| 414 | Package |
| 416 | First shell portion |
| 418 | Second shell portion |
| 420 | Insert |
| 422 | Latch |
| 424 | Openings (in latch 422) |
| 426 | Button assembly |
| 428 | First leg |
| 430 | Second leg |
| 432 | Actuator portion |
| 434 | Base sidewall |
| 436 | Opening |
| 438 | Latch abutment |

-continued

| | |
|---|---|
| 440 | Catch |
| 442 | Latch ramp |
| 448 | Lip ramp |
| 450 | Angled surface (of latch ramp 442) |
| 452 | Angled surface (of lid ramp 442) |
| 454 | Guides |
| 456 | Button |
| 458 | Spring |
| 460 | Tab |
| 462 | Cavity |
| 464 | Front sidewall |
| 466 | Opening (of front sidewall 464) |
| 468 | End portion |
| 470 | Opening |
| 472 | Button assembly guide |
| 474 | Slot |

DETAILED DESCRIPTION OF EXEMPLARY EMBODIMENTS

The present invention will now be described more fully with reference to the accompanying drawings, in which several embodiments are shown. This invention may, however, be embodied in many different forms and should not be construed as limited to the embodiments set forth here. Rather, these embodiments are examples of the invention, which has the full scope indicated by the language of the claims. Like numbers refer to like elements throughout.

Referring to FIGS. 1-5, a package 40 is shown having the following common features in the illustrated embodiments: a first shell portion 42, a second shell portion 44, a hinge 56, and a latch 58. A package is broadly defined here to be a package having two portions or leaves that are releasably joined so they can be closed or opened. The two portions or leaves do not need to be congruent, or the same size, or have matching edges to be a package as defined here.

In the illustrated embodiments, the first shell portion 42 has a first peripheral portion 46 and a second peripheral portion 48, and the second shell portion 44 has a first peripheral portion 50 and a second peripheral portion 52. The second peripheral portions 48 and 52 are the entire perimeters of the shell portions 42 and 44, except for the first peripheral portions 46 and 50.

In the illustrated embodiments, the second peripheral portion 52 of the shell portion 44 includes a first latching abutment 54 that is engaged or disengaged by the latch 58 as described below. In the illustrated embodiments, a hinge 56 joins the first shell portion 42 and second shell portion 44 at their first portions 46 and 50, defining a clamshell package. Hinges and hinged portions, however, are not essential and not necessary to carry out any embodiment of any invention disclosed in this specification. For example, in place of the hinge 56, the first and second shell portions 42 and 44 may have two or more hooks or another latch between their respective first peripheral portions 46 or 50 to releasably engage the first and second shell portions 42 and 44.

In the illustrated embodiments, a latch 58 can be provided for latching the second portions 48 and 52 of the first shell portion 42 and second shell portion 44 together. The illustrated latch 58 includes a first leg 60 and a second leg 62, an actuator portion 64, and a second latching abutment 66. The first and second legs 60 and 62 are joined at an angle (which is for example 90 degrees and/or corresponds to the respective angle between a side edge of the second shell portion 44 and the front edge of the second shell portion), and the first leg 60 is secured to the first shell portion 42.

Figure 2:
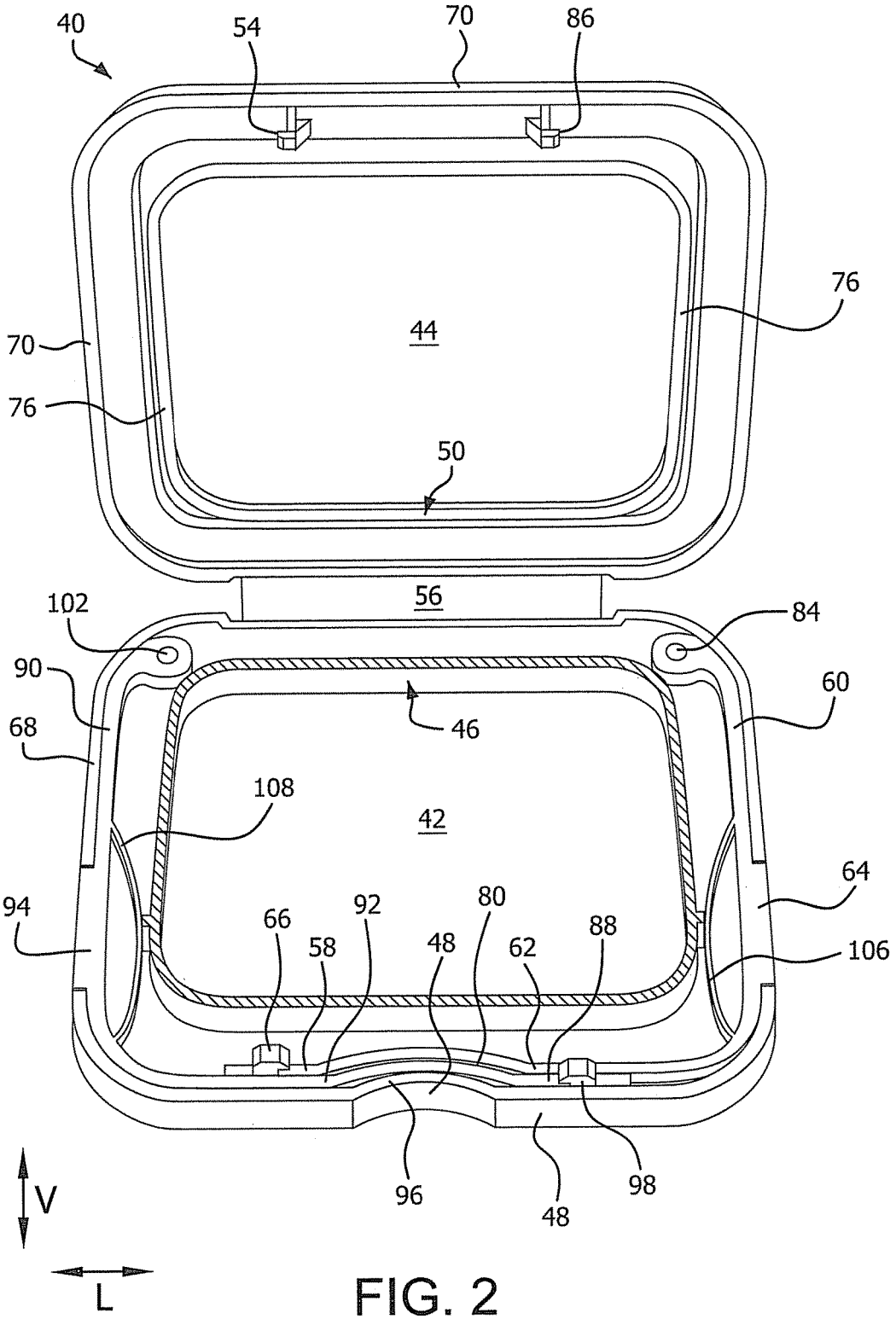
FIG. 2 is a view similar to FIG. 1, but having portions of the insert tray cut away to show underlying details.
Figure 2A:
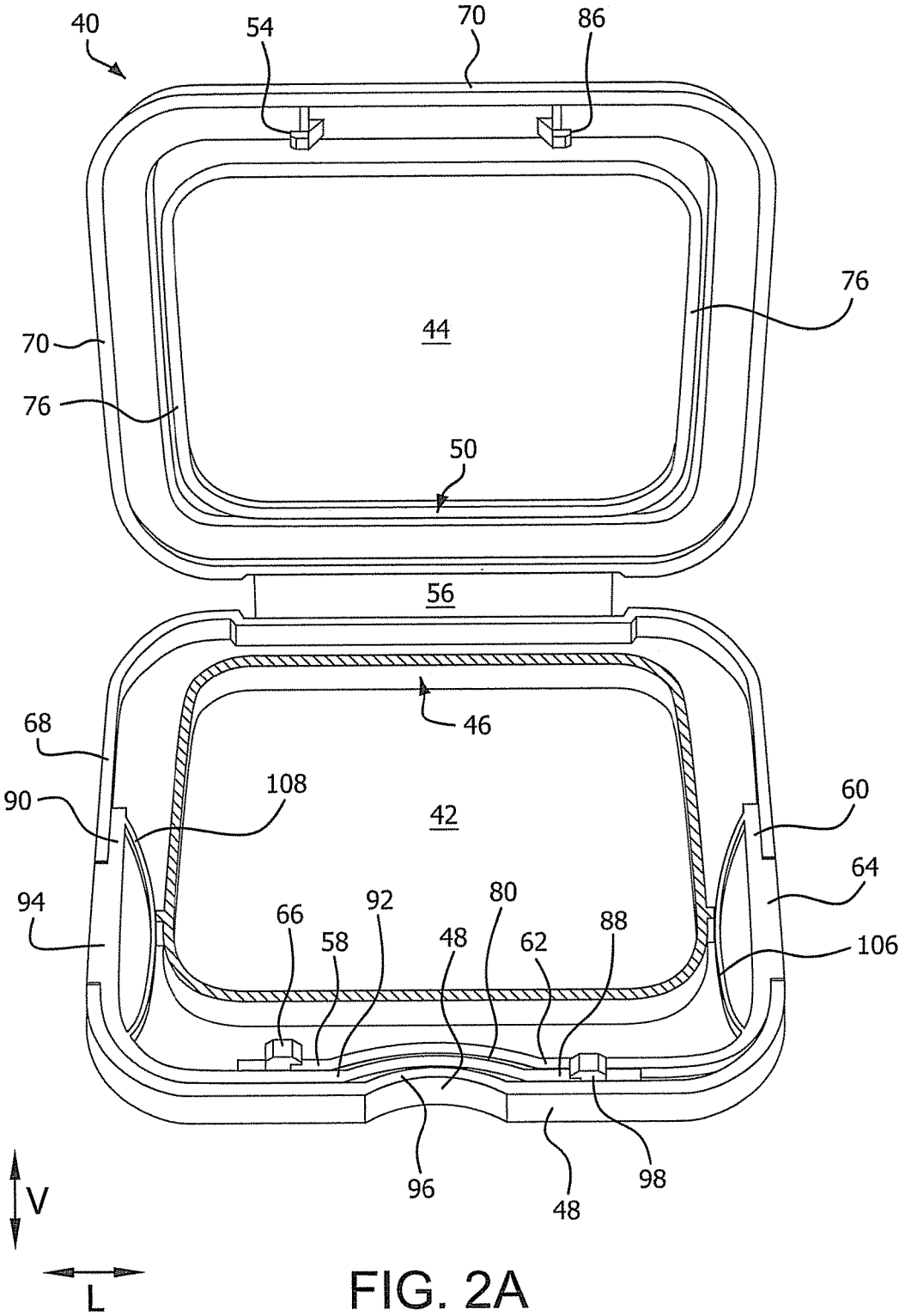
FIG. 2A is a view similar to FIG. 2, showing an alternative embodiment having modified first and third legs 60 and 90 and no pivots 84 and 102.
Figure 3:
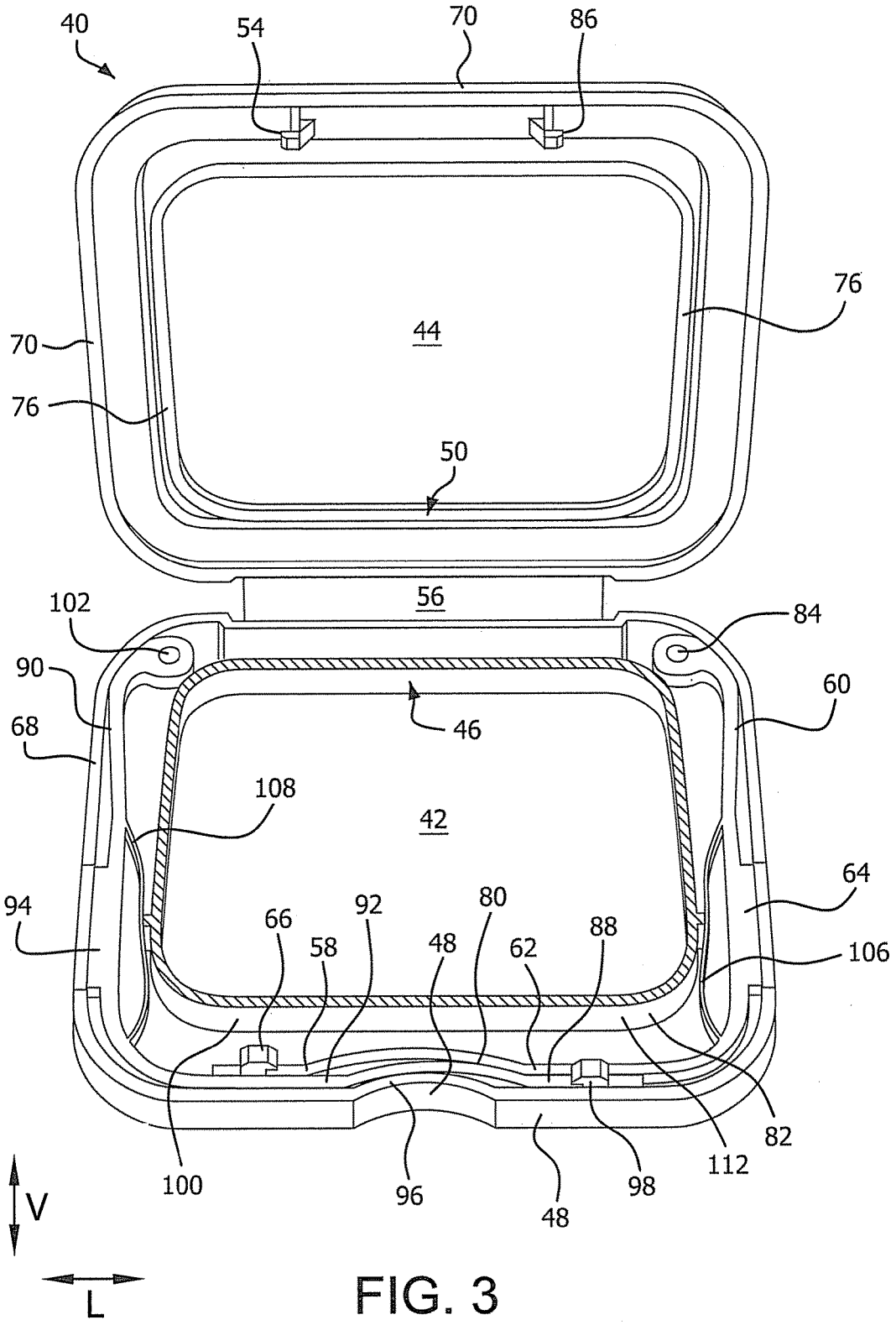
FIG. 3 is a view similar to FIG. 2, showing the latches advanced to their releasing positions.
Figure 3A:
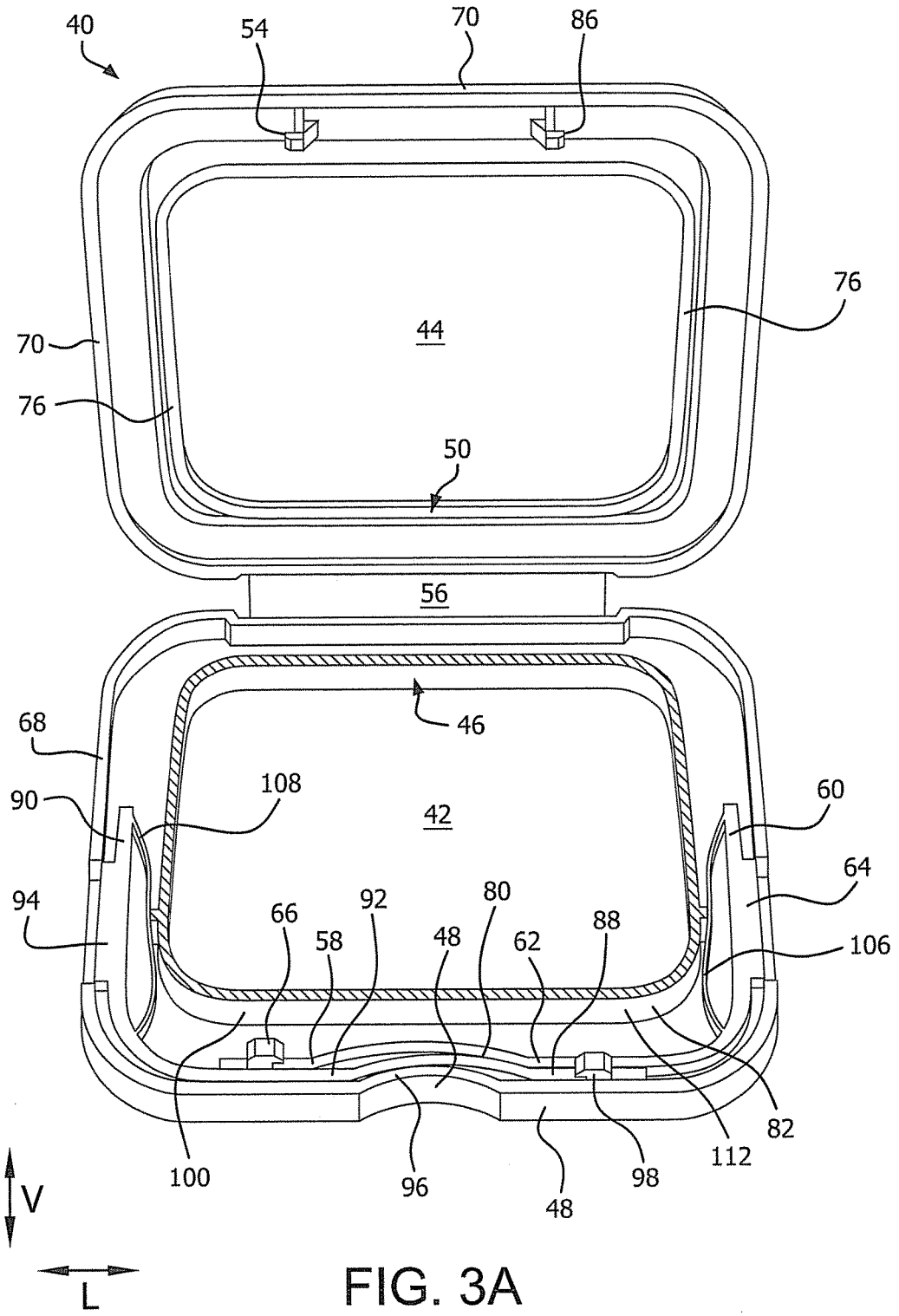
FIG. 3A is a view similar to FIG. 3, showing the alternative embodiment of FIG. 2A.
Figure 4:
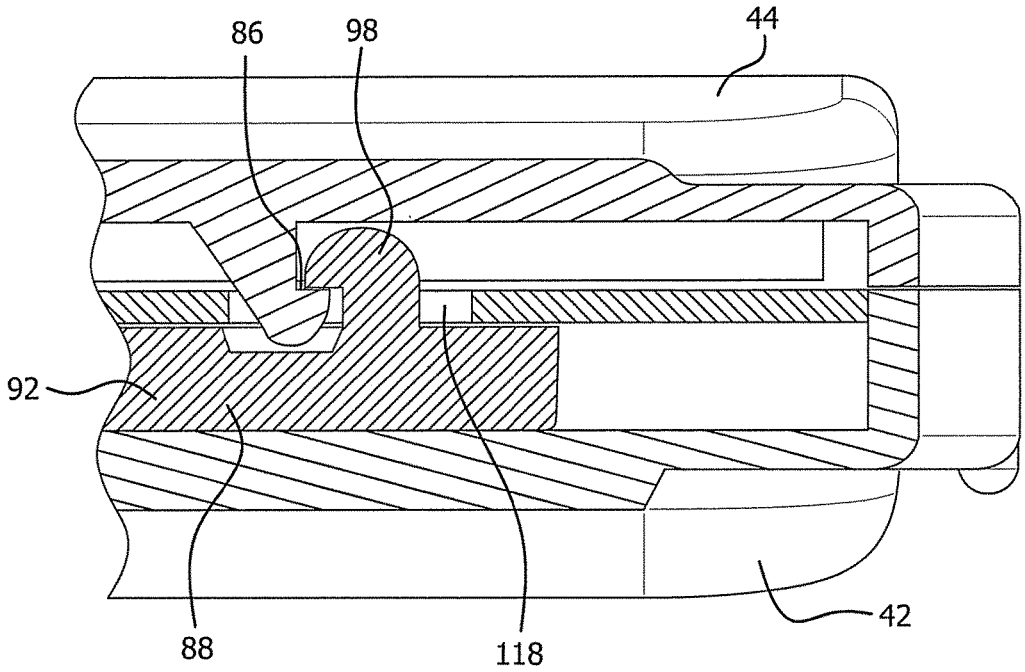
FIG. 4 is a detail side elevation view showing one of the latches engaged.
Figure 5:
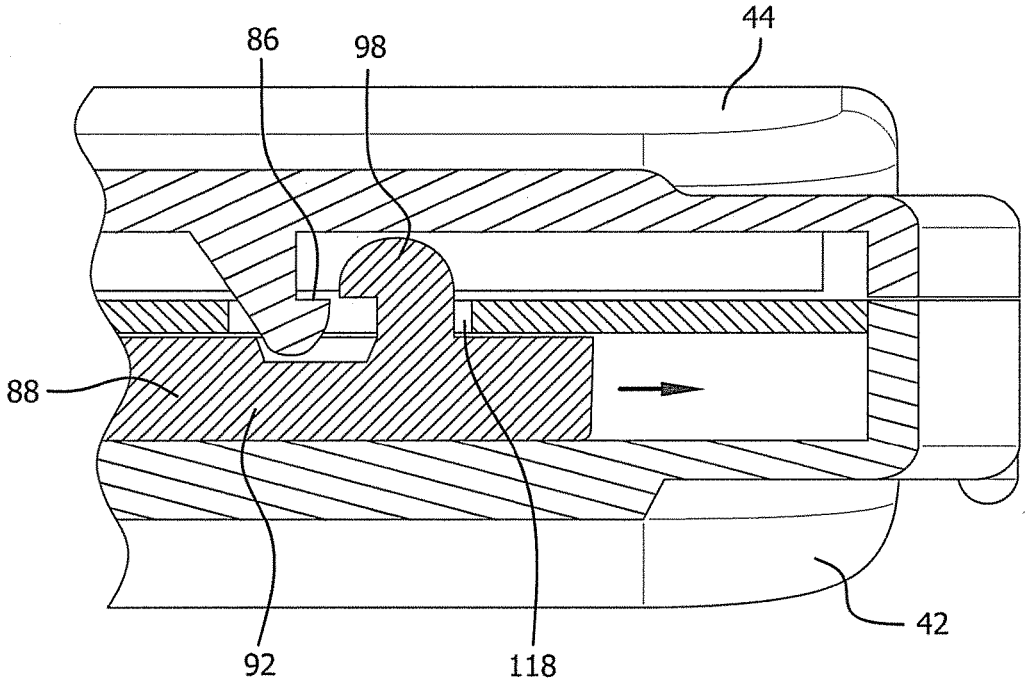
FIG. 5 is a view similar to FIG. 4, showing the latch disengaged.
Figure 6:
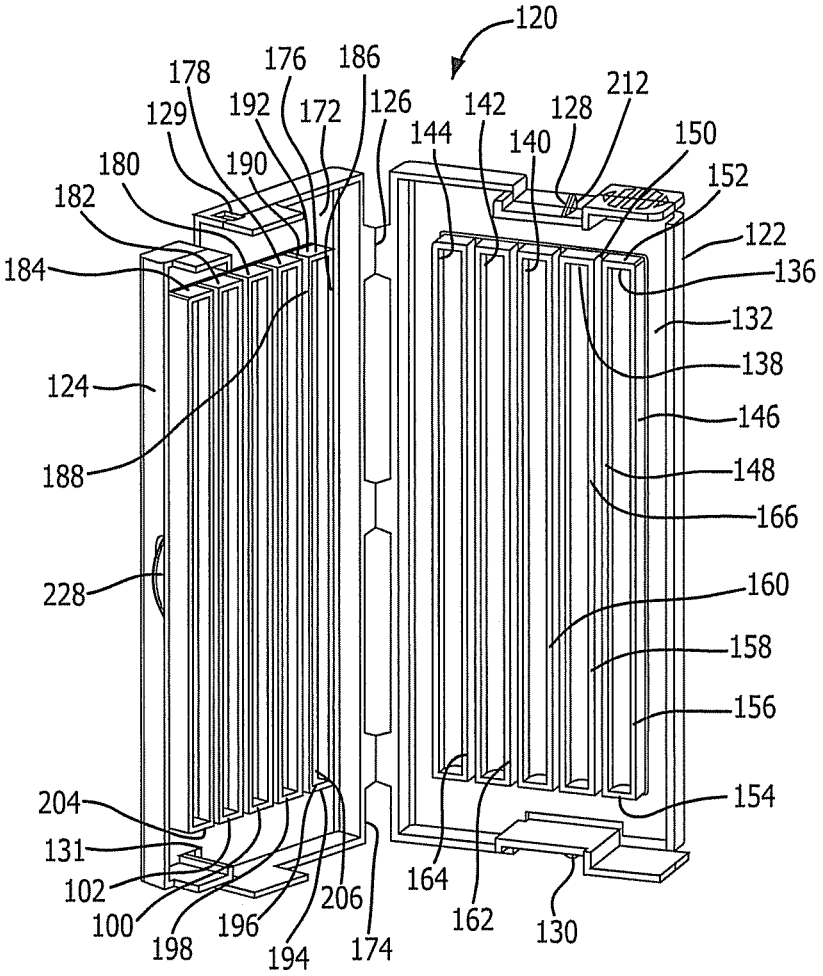
FIG. 6 is a perspective view of the package according to an embodiment of the invention, showing the package when open.
Figure 7:
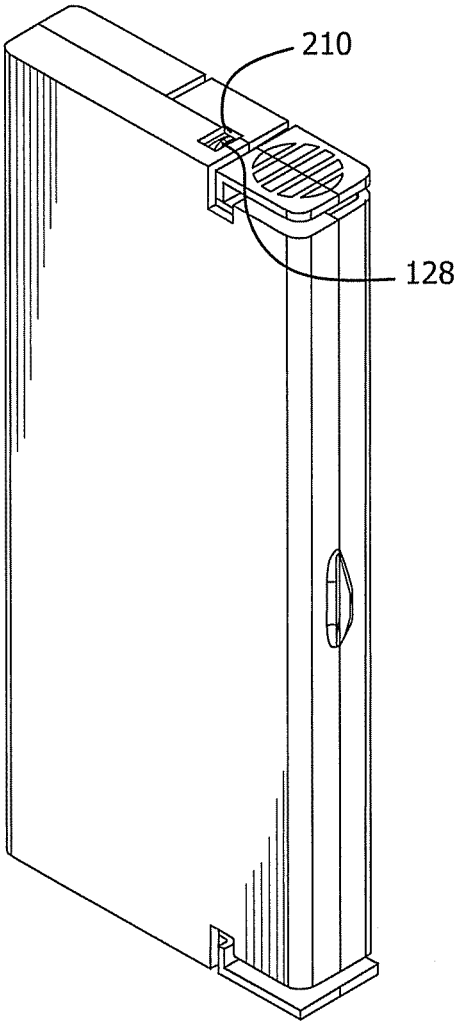
FIG. 7 is a perspective view of the embodiment of FIG. 6, showing the package when closed.
Figure 8:
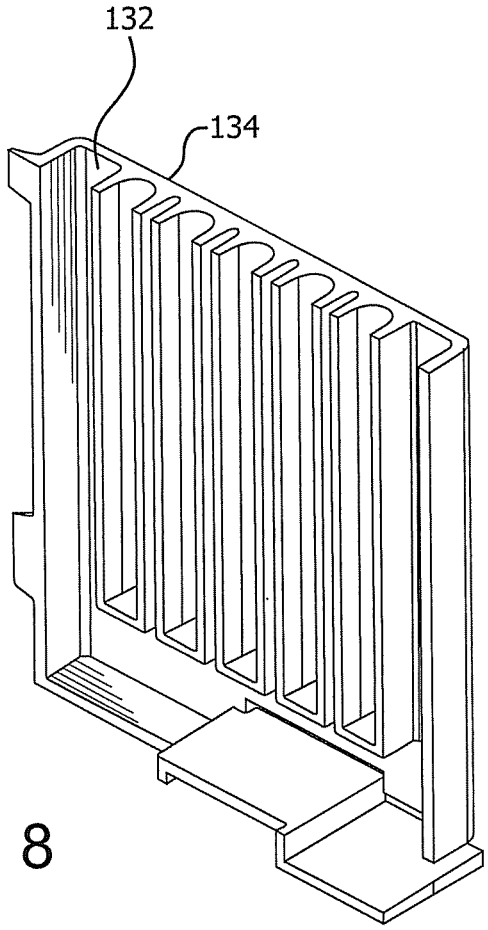
FIG. 8 is a cutaway view of the embodiment of FIG. 6, showing details of the base wells.

In the illustrated embodiments, an actuator portion 64 of the first leg 60 is positioned to be displaced generally laterally (in the direction indicated as "L" in FIGS. 1 through 3A) by a user's finger to displace the second leg 62 generally longitudinally from a latched position, illustrated in FIGS. 2 and 4, to a released position, illustrated in FIGS. 3 and 5. In the illustrated embodiments, the actuator portion 64 can be displaced laterally by pushing it inward with one's finger. In this embodiment the lateral displacement of the actuator portion is perpendicular to the first leg 60 (the first leg 60 extends in the direction indicated as "V" in FIGS. 1 through 3A), and thus also perpendicular to the side edge of the second shell portion 44, and parallel to the front edge of the second shell portion 44, since the second leg is arranged parallel to the front edge of the second shell portion 44 and since the angle between the two legs is 90 degrees. Optionally, as shown in FIGS. 2, 2A, 3, and 3A, a resilient element, such as the leaf spring 106, can be provided that resists this displacement and biases the actuator portion 64 toward its latched position. In the illustrated embodiments, the leaf spring 106 optionally bears against a portion of the insert 78 (a side wall defining recess 110, described below, in the illustrated embodiments), resiliently resisting the advance of the actuator portion 64.

In the illustrated embodiments, a second latching abutment 66 is secured to the second leg 62. The second latching abutment 66 in the illustrated embodiments is configured to engage the first latching abutment 54 when the second leg 62 is in its latched position, illustrated in FIGS. 1, 2, and 4, and to release the first latching abutment 54 when the second leg 62 is in its released position, illustrated in FIGS. 3 and 5. Optionally, as shown in FIGS. 2 and 3, a leaf spring 108, can be provided that functions like the leaf spring 106.

In addition to the common and optional features in the illustrated embodiments, the package 40 illustrated in the Figures can have any one or more of numerous additional optional features. Zero, one, or more than one of these optional features can be employed, whether individually or in any combination.

A first optional feature of the embodiments of FIGS. 1-5 is that the first and second shell portions 42 and 44 can have mating peripheral edges 68 and 70. Mating peripheral edges are defined as peripheral edges that are generally congruent and registered when the package 40 is closed.

A second optional feature of the embodiments of FIGS. 1-5 is that a lip seal arrangement can be provided to isolate the interior of the package 40 from the exterior environment when the package 40 is closed. For example, the package 40 can include a first closed lip 72 on the first shell portion 42 defining an enclosure 74, and a mating second closed lip 76 on the second shell portion 44. The second closed lip 76 can be positioned to engage the first closed lip 72 and seal the enclosure 74 from the ambient air outside the enclosure 74 when the first shell portion 42 and second shell portion 44 are latched. "Closed loop" means that a lip is endless or continuous, like a ring. The loop can be round, oval, rectangular with rounded corners, irregular, or have some other shape.

A third optional feature of the embodiments of FIGS. 1-5 is that an insert 78 can be provided as part of the first shell portion, defining the first closed lip 72 and joined to the remainder 104 of the first shell portion 42. The insert 78 illustrated in FIG. 1 can take the form of a tray 78 having a recess 110 located within the closed lip 72 and defined by a sidewall 112. The recess can define a sealed portion of the container. The tray 78 also can include a peripheral flange 114 located outside the closed lip 72. In the illustrated embodiments, the peripheral flange 114 conceals most of the latches 58 and 88 but includes apertures 116 and 118 to allow engagement between the first and second latching abutments 54 and 66, and between the third and fourth latching abutments 86 and 98.

A fourth optional feature of the embodiments of FIGS. 1-5 is that at least a portion of the latch 58 and at least a portion of the latch 88 can be positioned between the flange 114 of the insert 78 and the first shell portion 42. This conceals the latches 58 and 88, while providing the sidewall 112 that acts as a bearing surface against which the second and fourth legs 62 and 92 or the leaf springs 106 and 108 can bear to bias the latches 58 and 88 toward their latched positions. It should be understood that the second latch 88 and the structure it engages are not essential or necessary, as a single latch can alternatively be provided to adequately latch the container closed. For example, the single latch 88 can be modified to carry both the second and fourth abutments 66 and 98, which can be modified so both latch in the same direction.

A fifth optional feature of the embodiments of FIGS. 1-5 is that a bending ramp 80 can be positioned to be engaged by the second leg 62 for bending the second leg 62 into contact with a biasing abutment 82 when the second leg 62 is displaced generally longitudinally from the latched position (shown for example in FIGS. 1, 2, and 4) toward the released position (shown for example in FIGS. 3 and 5). In the illustrated embodiments, the bending ramp 80 is a bent portion of the fourth leg 92, which has the advantage that the bending ramp 80 moves to the right while the second leg 62 moves to the left as the latches 58 and 88 move in opposite directions toward their respective unlatched positions. The relative movement of the two latches doubles their passing rate, compared to the rate of travel of either latch relative to fixed structure, doubling the bending rate of the second leg 62.

A sixth optional feature of the embodiments of FIGS. 1-5 is that the first leg 60 can be secured to the first shell portion 42 by a pivot 84. The provision of a pivot 84 allows a user to displace the actuator portion 64 to pivot the first leg 60 relative to the first shell portion 42. Alternatively, the pivot 84 can be replaced by a fixed attachment point or a bearing point, either of which would provide another, or an alternative, biasing force to bias the latch 58 toward its latched position, assuming the first leg 60 is resilient.

An seventh optional feature of the embodiments of FIGS. 1-5 is that the container latching arrangement can further include a third latching abutment 86 and a second latch 88. The third latching abutment 86 can be provided on either one of the first and second shell portions 42 and 44. The second latch 88 can be provided for releasably latching the second portions 48 and 52 of the first shell portion 42 and second shell portion 44 together.

An eighth optional feature of the embodiments of FIGS. 1-5 is that the second latch 88 can include third and fourth legs 90 and 92, an actuator portion 94, and a fourth latching abutment 88. The third and fourth legs 90 and 92 can be joined at an angle, as illustrated here. The third leg 90 can be secured to the other of the first and second shell portions 42 and 44 relative to the third latching abutment 86. The actuator portion 94 of the third leg 90 can be positioned to be displaced generally laterally by a user's finger. Displacing the actuator portion 94 of the third leg 90 in the illustrated embodiments displaces the fourth leg 92 generally longitudinally from a latched position to a released position.

The fourth latching abutment 88 can be secured to the fourth leg 92. The fourth latching abutment 88 can be configured, as shown in the illustrated embodiments, to engage the third latching abutment 86 when the fourth leg 92 is in its latched position. The fourth latching abutment 88 can be configured, as shown in the illustrated embodiments, to release the third latching abutment 86 when the fourth leg 92 is in its released position.

A ninth optional feature of the embodiments of FIGS. 1-5 is that the actuator portions 64 and 94 of the first and third legs 60 and 90 can be spaced at least five cm apart, optionally at least six cm apart, optionally at least seven cm apart, optionally at least 8 cm apart, optionally at least 9 cm apart, optionally at least 10 cm apart.

A tenth optional feature of the embodiments of FIGS. 1-5 is that the actuator portions 64 and 94 of the first and third legs 60 and 90 optionally can be arranged so they must be actuated simultaneously to unlatch the second portions 48 and 52 of the first shell portion 42 and second shell portion 44.

The ninth and tenth optional features, or either one of them, can be employed to provide a child resistant but elder friendly package 40. Desirably for this purpose, the actuator portions 64 and 94 are far enough apart that a small child who should not have access to the contents of the package 40 will find it difficult or impossible to operate both simultaneously with one hand. Desirably, the actuator portions 64 and 94 are close enough together that an adult who should have access to the contents of the package 40, including an elderly person, will find it possible, preferably easy to operate both actuator portions 64 and 94 simultaneously with one hand to open the package.

As an eleventh optional child-resistant feature, the embodiments of FIGS. 1-5 does not have an opening spring, strut, or the like to open the package automatically when it is unlatched. When the latches 58 and 88 are disengaged, the second shell portion 44, which in this case is the lid, does not spring open automatically; the second shell portion 44 must be lifted manually to open the package. For this purpose, the first shell portion 42 has an indentation coinciding with the bending ramp 96, and the second peripheral portion 52 of the second shell portion 44 bridges the indentation.

The user can lift the section of the second peripheral portion 52 bridging the indentation of the closed package 40, when the latches 58 and 88 are released, to open the package 40 and have access to its contents. This is a child-resistant feature because, in normal operation, both actuator portions 64 and 94 are engaged with one hand and the second shell portion 44 is lifted with the other. The user's hand must be large enough to engage the two actuator portions 64 and 94 at the same time to open the package. Yet, opening the package 40 does not require complex movement, such as grasping and twisting one part relative to another, and can easily be designed by controlling the necessary biasing force so it does not require great strength to open.

A twelfth optional feature of the embodiments of FIGS. 1-5 is that the second and fourth legs 62 and 92 optionally can be positioned generally parallel while in their latched positions. "Generally parallel" means that a majority of the length of the respective legs runs side by side at approximately the same distance apart along their mutual lengths when the package is latched. As will be understood from this specification, the legs need not remain parallel when the package 40 is unlatched, as part of their respective motion is lateral.

A thirteenth optional feature of the embodiments of FIGS. 1-5 is that the second and fourth legs 62 and 92 optionally can be positioned to be displaced generally longitudinally in opposite directions from their latched positions to their released positions.

A fourteenth optional feature of the embodiments of FIGS. 1-5 is that bending ramps 80 and optionally 96 can be positioned to be engaged by one or optionally both of the second and fourth legs 62 and 92 for bending the engaged leg 62 or 92 into contact with a biasing abutment 98 or 100 when the engaged leg 62 or 92 is displaced generally longitudinally from the latched position toward the released position.

In the illustrated embodiments, both of the second and fourth legs 62 and 92 engage a bending ramp, respectively the bending ramp 80 defined by the fourth leg 92 and the bending ramp 96 defined by an indentation of the wall defining the second portion 48 of the first shell portion 42. This juxtaposition of two bending ramps increases the lateral displacement of the second leg 62 when the package 40 is unlatched, which can be explained as follows. Engaging the bending ramp 96 with the fourth leg 92 displaces the fourth leg 92, and thus the bending ramp 80, laterally inward with respect to the package, also displacing the second leg 62 laterally inward. Engaging the bending ramp 80 with the second leg 62 further displaces the second leg 62 further laterally inward. This provides a movement comparable to a compound lever. Optionally, just the second leg 62 will bear against the sidewall 112, or optionally or additionally against the wall of the aperture 116, to produce a biasing force tending to resist unlatching.

A fifteenth optional feature of the embodiments of FIGS. 1-5 is one way for biasing the actuator portion toward its latched position. A first bending ramp 80 can be provided that is positioned to be engaged by the second leg 62 for bending the second leg 62 into contact with a first biasing abutment 82 when the second leg 62 is displaced generally longitudinally from its latched position toward its released position.

In a sixteenth, optional elaboration of this mechanism, a second bending ramp 96 can be provided and positioned to be engaged by the fourth leg 92 for bending the fourth leg 92 into contact with a second biasing abutment 100 when the fourth leg 92 is displaced generally longitudinally from its latched position toward its released position.

A seventeenth optional feature of the embodiments of FIGS. 1-5 is that the first leg 60 can be secured to the first shell portion 42 by a first pivot 84, and the third leg 90 also can be secured to the first shell portion 42 by a second pivot 102.

Referring to FIGS. 6-20, a package 120 includes a base shell 122, a lid shell 124, an integral hinge 126, a first closure 128, and a second closure 130. The can be manufactured by different processes depending on the specifics of the design. In the illustrated embodiments, the base shell 122, lid shell 124, integral hinge 126, and closures 128 and 130 are formed as a single injection molded part 120, molded in one shot in one mold. In alternative embodiments, one or more components or portions can be formed separately and joined to form a one-piece package, or the respective components can be formed in more than one mold or more than one shot. The package also can be blow molded or thermoformed.

The base shell 122 has inside and outside surfaces 132 and 134. It has at least a first base well, and here five base wells 136, 138, 140, 142, and 144, on the inside surface 132. The wells are formed by depressions in the base shell 122. In the illustrated embodiment, each base well such as 136 is defined by an upstanding wall 146 extending from the base shell 122 to the generally flat marginal sealing surface and encircling the well such as 136. In the illustrated embodiment, the upstanding walls 146 and 148 of at least two adjacent base wells, and here of all five illustrated base wells, are spaced apart, defining a gap such as 150 between them.

In the illustrated embodiment, the base wells 136-144, and more particularly the upstanding walls such as 146 and 148, reinforce the base shell 122 against deformation. This reinforcement is useful to stiffen the base shell 122 against bending, thus keeping its contents more secure against access to the contents of the base wells 136-144 by prying or otherwise bending the base shell 122 while the package 120 is closed and the closures 128-131 are engaged.

In the illustrated embodiment, the base wells such as 136 have a length (measured along the longer upstanding walls such as 146 and 148) and width (measured along the shorter upstanding walls such as 152 and 154) generally parallel to the generally flat marginal sealing surface 156-164 of the base shell 122 and a depth generally perpendicular to the generally flat marginal sealing surface 156-164 of the base shell 122.

In the illustrated embodiment the marginal sealing surface 156-164 is a discontinuous surface defined by the generally coplanar marginal sealing surfaces 156, 158, 160, 162, and 164 of the respective base wells 136, 138, 140, 142, and 144) of the base shell 122. In an alternative embodiment, the facing upstanding walls such as 148 and 166 between two wells can be merged, thus reducing or eliminating the gaps such as 150 and potentially joining the portions of the marginal sealing surface 156-164 to form a single, continuous sealing surface 156-164.

Figure 16:
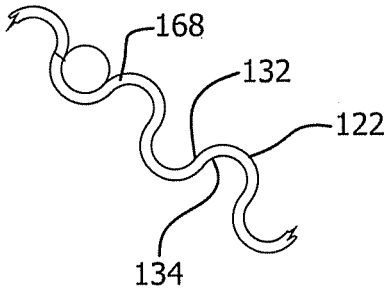
FIG. 16 is a detail view of another embodiment of the package, showing a corrugated shell wall for the base shell and/or lid shell.

In an alternative embodiment, shown in FIG. 16, a base well is formed by a corrugation 168 in the base shell 122. In the corrugated structure, the inside surface 132 and the outside surface 134 both undulate.

In the illustrated embodiment, the base wells 136-144 have lengths at least three times as great as their widths, and as illustrated roughly twenty times as great as their widths.

The lid shell 124 also has inside and outside surfaces 172 and 174. It has at least first and second lid wells, and here five lid wells 176, 178, 180, 182, and 184, on the inside surface 172. The wells can be formed by depressions in the lid shell 124. In the illustrated embodiment, each lid well such as 176 is defined by an upstanding wall 186 extending from the lid shell 124 to the generally flat marginal sealing surface and encircling the well such as 176. In the illustrated embodiment, the upstanding walls 186 and 188 of at least two adjacent lid wells, and here of all five illustrated lid wells, are spaced apart, defining a gap such as 190 between them.

In the illustrated embodiment, the lid wells 176-184, and more particularly the upstanding walls such as 186 and 188, reinforce the lid shell 124 against deformation. This reinforcement is useful to stiffen the lid shell 124 against bending, thus keeping its contents more secure against access to the contents of the lid wells 176-184 by prying or otherwise bending the lid shell 124 while the package 20 is closed and the closures 128-131 are engaged.

In the illustrated embodiment, the lid wells such as 176 have a length (measured along the longer upstanding walls such as 186 and 188) and width (measured along the shorter upstanding walls such as 192 and 194) generally parallel to the generally flat marginal sealing surface 196-204 of the lid shell 124 and a depth generally perpendicular to the generally flat marginal sealing surface 196-204 of the lid shell 124.

In the illustrated embodiment the marginal sealing surface 196-204 is a discontinuous surface defined by the generally coplanar marginal sealing surfaces 196, 198, 200, 202, and 204 of the respective lid wells 176, 178, 180, 182, and 184) of the lid shell 124. In an alternative embodiment, the facing upstanding walls such as 198 and 206 between two wells can be merged, thus reducing or eliminating the gaps such as 190 and potentially joining the portions of the marginal sealing surface 196-204 to form a single, continuous sealing surface 196-204.

In the illustrated embodiment, the lid wells 176-184 have lengths at least three times as great as their widths, and as illustrated roughly twenty times as great as their widths.

In the illustrated embodiment, the portions of the base shell 122 and the lid shell 124 separating the base wells 136-144 from the outside of the container are each at least 0.5 mm thick, alternatively at least 0.8 mm thick, alternatively at least 1 mm thick, alternatively at least 2 mm thick, and can be thick enough to provide a sufficient barrier layer and seal against the passage of moisture, oxygen, or both to meet the needs of particular articles carried in the wells. The shells can be made, for example, from polyethylene or polypropylene.

The integral hinge 126 joins the base shell 122 and lid shell 124. The hinge 126 allows the base shell 122 and lid shell 124 to close together in fashion. A non-integral hinge can also optionally be used, though it might add to the cost of manufacture.

Figure 12:
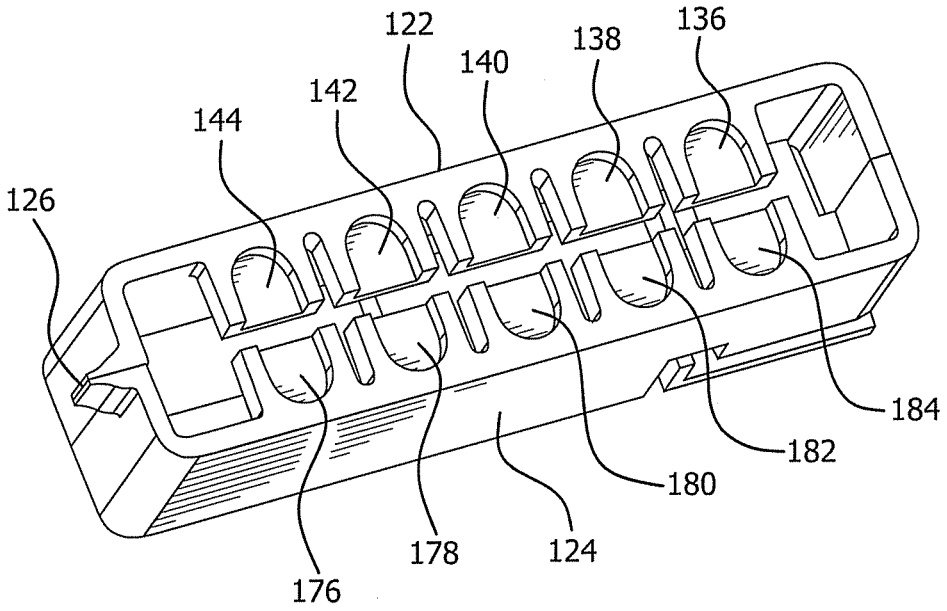
FIG. 12 is a perspective view of the embodiment of FIG. 6, showing the package when closed, cut away to show the relation of the base wells and lid wells.
Figure 13:
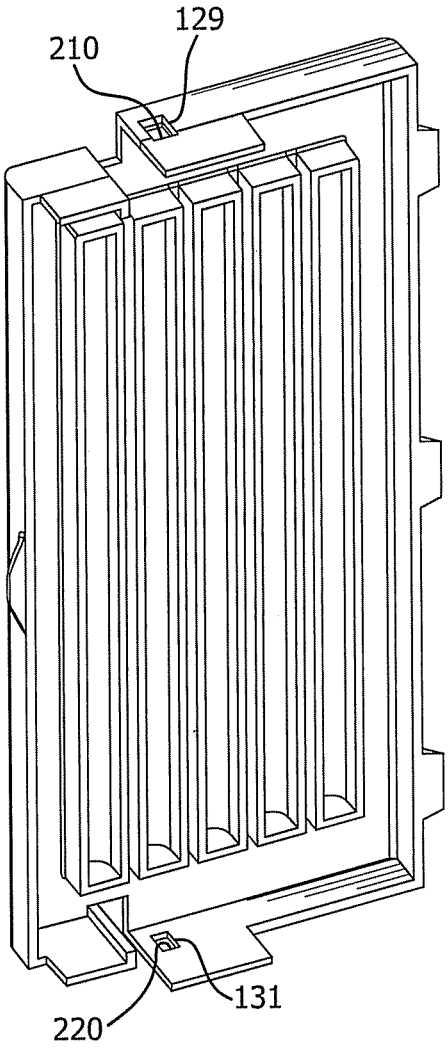
FIG. 13 is a perspective view of the lid shell of the embodiment of FIG. 6.

The package 120 has at least one closure, and in this embodiment has two. When the package 120 is closed, the marginal sealing surfaces of the lid shell 124 and base shell 122 are facing and adjacent to each other, as shown in FIG. 12, preventing access to the wells. The closure, and in this instance the first closure 128-129 and the second closure 130-131, releasably secure the base shell 122 to the lid shell 124 when closed.

The first closure 128-129 comprises at least a first upward-facing lid abutment 210 (see FIGS. 7 and 13) secured to the lid shell 124 and at least a first downward-facing base abutment 212 of the first closure detent 128 secured to the base shell 122 and normally bearing against the lid abutment 210 when the package 120 is closed (as shown in FIG. 2). In an alternative embodiment, the first closure can be centrally located and a single closure can be used to secure the package 120.

Figure 9:
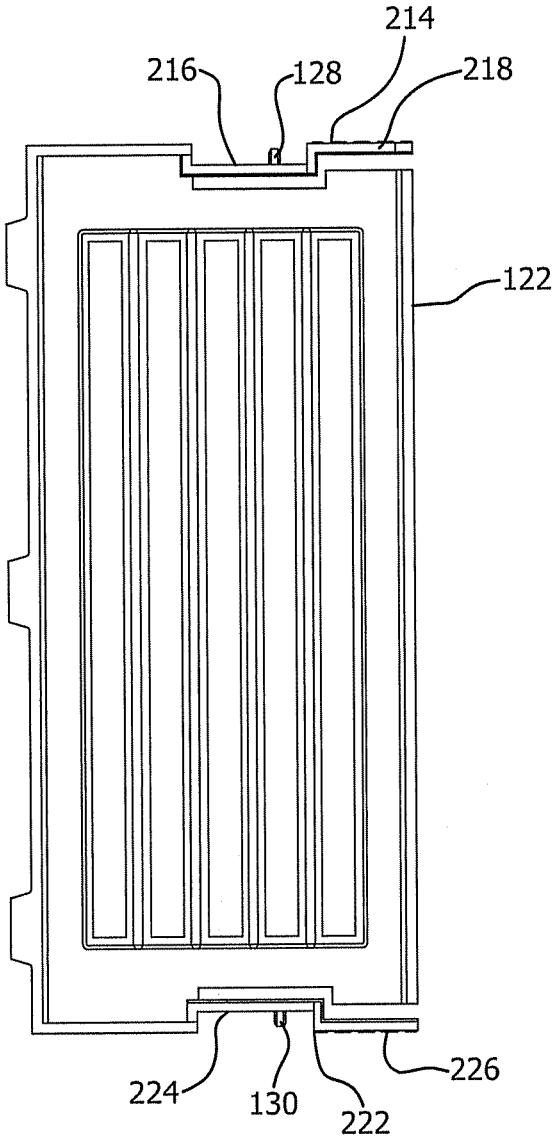
FIG. 9 is a plan view of the embodiment of FIG. 6, showing the interior of the base shell.
Figure 10:
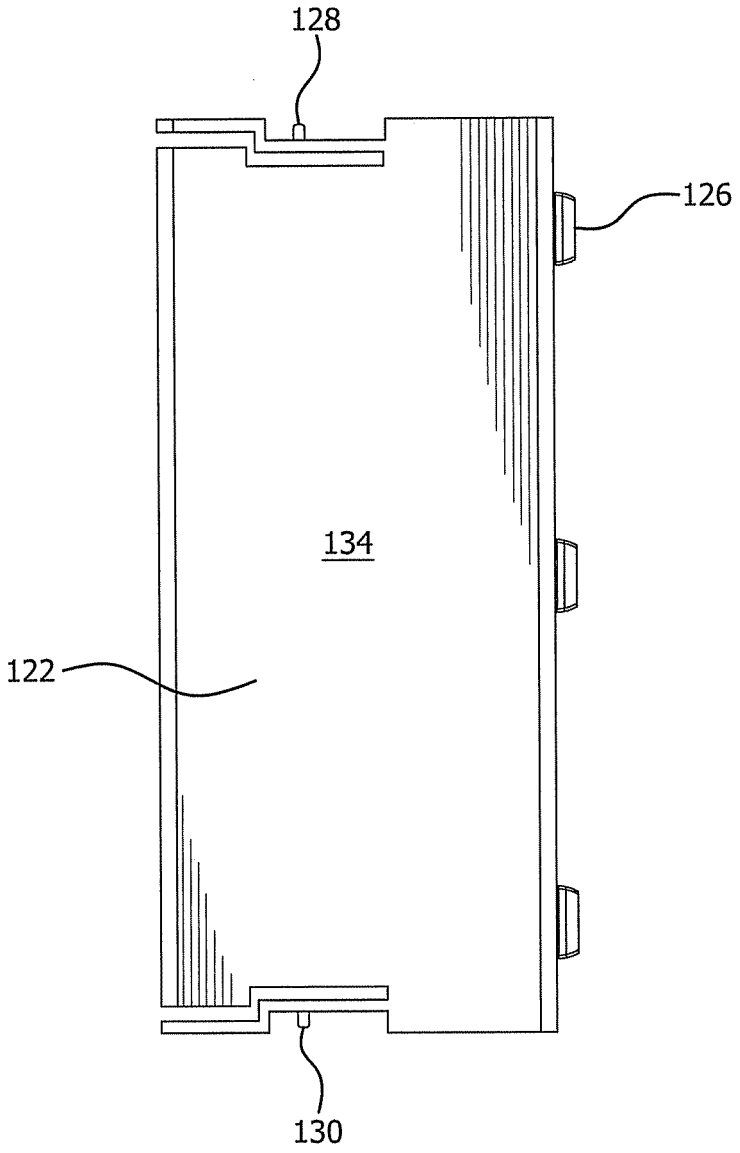
FIG. 10 is a plan view of the embodiment of FIG. 6, showing the exterior of the base shell.
Figure 11:
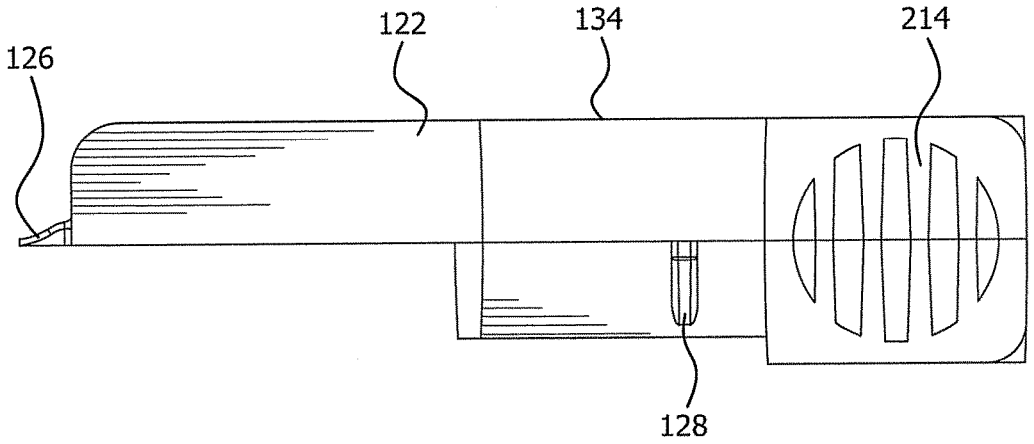
FIG. 11 is a side elevation view of the exterior of the base shell in the embodiment of FIG. 6.

The first downward-facing base abutment 212 is resiliently mounted to the corresponding (base) shell 122, as is best seen by reference to FIG. 9. The detent 128 is mounted to a resilient tab 214 on its proximal portion 216. The distal portion 218 of the resilient tab is offset in this embodiment to increase the amount the tab 214 can be deflected downward (with reference to the orientation of FIG. 9) without touching the remainder of the package 120.

The first downward-facing base abutment 212 carried on the tab 214 is normally biased to the as-molded position shown in the Figures, at which it engages the first upward-facing lid abutment 210 (see FIGS. 7 and 13) secured to the lid shell 124, so the detent 128 is inserted into the aperture 129. The first downward-facing base abutment 212 is resiliently deflectable against its bias, in this case toward the remainder of the package 120, to disengage the first upward-facing lid abutment 210, releasing the first closure 128 by removing the detent 128 from the aperture 129.

The second closure 130-131 comprises at least a second upward-facing lid abutment 220 (see FIGS. 7 and 13) secured to the lid shell 124 and a second downward-facing base abutment 212 of the second closure detent 130 secured to the base shell 122 and normally bearing against the lid abutment 220 when the package 120 is closed.

The second downward-facing base abutment on the detent 130 is resiliently mounted to the corresponding (base) shell 122, as is best seen by reference to FIG. 9. The detent 130 is mounted to a resilient tab 222 on its proximal portion 224. The distal portion 226 of the resilient tab 222 is offset in this embodiment to increase the amount the tab 222 can be deflected upward (with reference to the orientation of FIG. 9) without touching the remainder of the package 120. The second closure 130-131 functions in the same manner as the first closure 128-129 as described above.

The first closure 128 is spaced from the second closure 130. In the illustrated embodiment, the first and second closures 128-129 and 130-131 normally must be operated at least substantially simultaneously to open the package 120. The resiliently mounted abutments of the first and second closures are operable, as by pinching the distal portions 218 and 226 with a finger and the thumb of one hand, to release the closures by urging the resiliently mounted abutment of one closure toward the resiliently mounted abutment of another closure. While the distal portions 218 and 226 are pinched inward using one hand, the thumb tab 228 can be engaged to open the package. The need to manipulate two resilient tabs and a thumb tab on different parts of the package 120 renders the closure child-resistant, but still relatively easy to open for an adult having a larger hand span than a young child.

Figure 14:
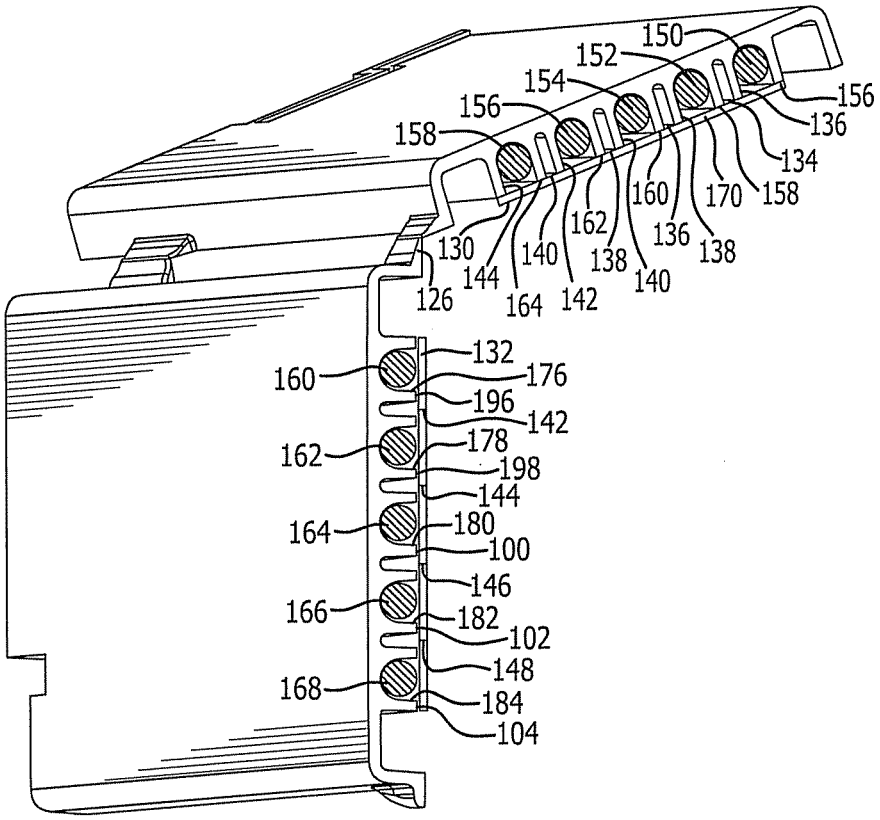
FIG. 14 is a perspective view of the embodiment of FIG. 6 when open, cut away to show the wells and shown with product sticks in the wells and seal sheets covering the sells.

The package 120 as illustrated in FIG. 14 includes a sealing sheet 230 adhered to the generally flat marginal sealing surfaces 156-164 encircling the base wells 136-144 to hermetically seal the individual base wells. The sealing sheet can be attached, for example, by ultrasonic welding, solvent welding, heat sealing, an adhesive, or other expedients, including those known in the art. The package 120 as illustrated in FIG. 14 also includes a sealing sheet 232 adhered to the generally flat marginal sealing surfaces 196-204 encircling the lid wells 176-184 to hermetically seal the individual lid wells. Optionally, the sealed wells can be "moisture-tight," which is defined below.

If no seal is required in a given instance, then the flexible film does not need to have the barrier and sealing properties to provide a seal. For example, a paper seal can be used. In another embodiment, the design of the pockets can be such as to restrain the product in the package so no flexible film is required The flexible film material can be formed in a way that allows one compartment at a time to be opened. The sealing sheets 230 and 232 optionally can be weakened, cut, or perforated, for example between adjacent wells, as at the cuts 234-240 of the sheet 230 and the cuts 242-248 of the sheet 232, to define separately removable strips such as 270 (between two adjacent cuts such as 234 and 236) that can be individually removed to unseal or open one well without unsealing or opening an adjacent well. To access the product, the consumer would peel away the flexible film material exposing one of the compartments. Additionally or instead, a tool could be used to open the compartments. Another option is to provide a pull tab that has a string or other material that is pulled through the flexible film covering a well, opening the compartment.

In various embodiments, the sheets 230 and 232 can originally be two separate sheets or portions of one sheet that bridges the integral hinge. The bridging web of the sheet can either be removed or left in place.

An embodiment of another aspect of the invention is a method of filling the package 120 with a product. Pieces of the product, for example the stick-shaped product pieces 252-268 shown in FIG. 14 in cross-section, are placed in the base and lid wells 136-144 and 176-184. The wells 136-144 and 176-184 of the base shell 122 and lid shell 124 are covered with cover sheets 230 and 232 to close them. The cover sheets 230 and 232 are sealed to the generally flat marginal sealing surfaces 156-164 and 196-204 to seal the wells 136-144 and 176-184. Portions of the cover sheets 230 and 232 between two wells are weakened or cut at the cuts 234-240 of the sheet 230 and the cuts 242-248 of the sheet 232 to form strips such as 270 of the cover sheet between two cuts. In an embodiment, each strip such as 270 of the cover sheet covers one well, although alternatively they could cover more than one well per strip 270, as when the objects to be dispensed are pharmaceutical tablets and the recommended dose is two tablets at a time. In an embodiment, each strip is removable separately from one or more adjacent strips of the cover sheet covering different wells.

Figure 15:
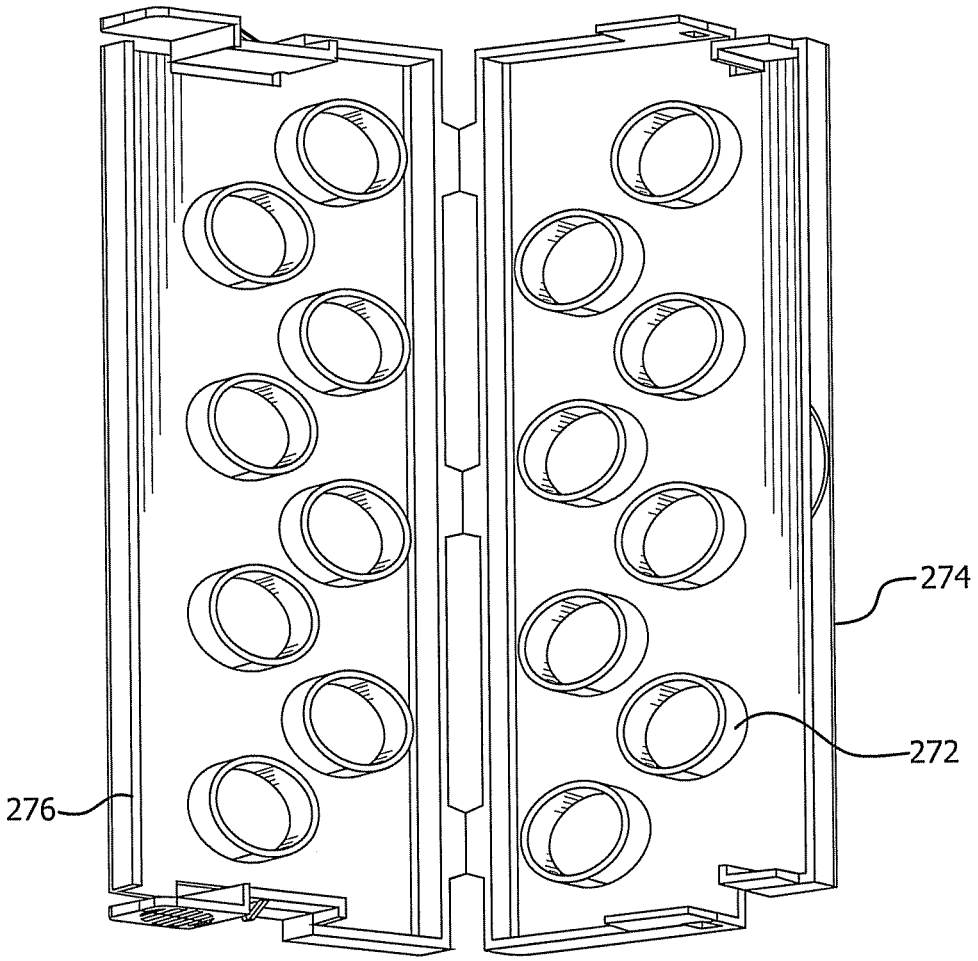
FIG. 15 is a perspective view of another embodiment of the package, showing a different well arrangement and shape.

Another embodiment of the invention is shown in FIG. 15, in which the wells such as 272 are generally circular and provided in two offset lines in the lid 274, and also in the base 276. This embodiment can be used for tablets or disk-shaped or coiled dosage forms or other objects. The illustrated wells of the lid and base do not intersect when the package is closed. One utility for offset base and lid wells is to allow a pull tab or other structure for opening each base well to project into the space between the offset lid wells, and vice versa. Alternatively, the offset wells of the lid and base could interleave, so the base wells faced and projected into a portion of the lid between two lid wells, and vice versa.

FIG. 16 is a detail view of another embodiment of the package, showing a corrugated shell wall for the base shell 122, which could also be used for the lid shell 124. In this embodiment, both the inside and outside surfaces 132, 134, are corrugated.

Figure 17:
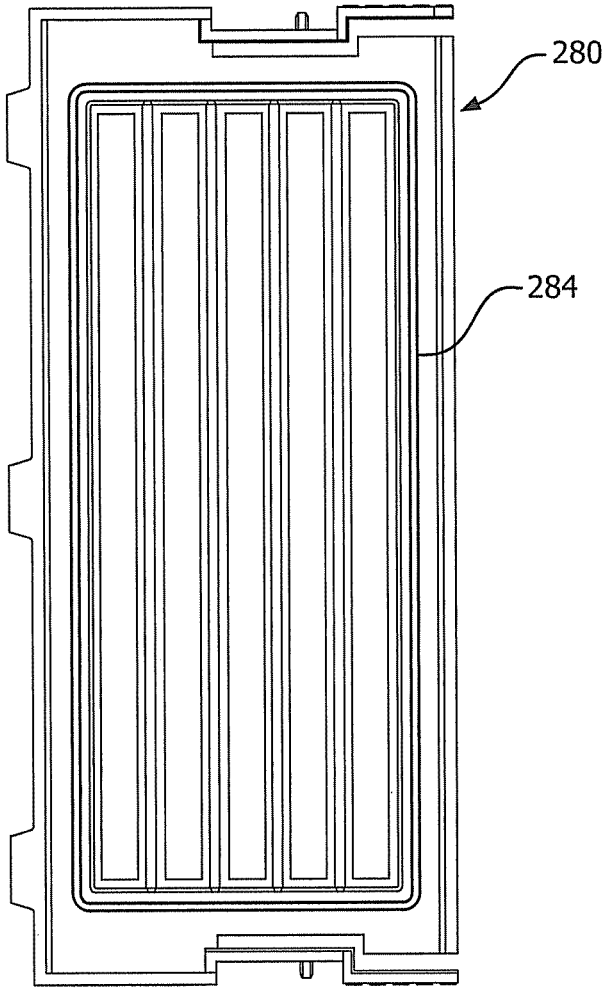
FIGS. 17 (showing a base shell) and 18 (showing a lid shell) are views similar to FIGS. 9 and 13 of another embodiment having a perimeter seal around the wells.
Figure 18:
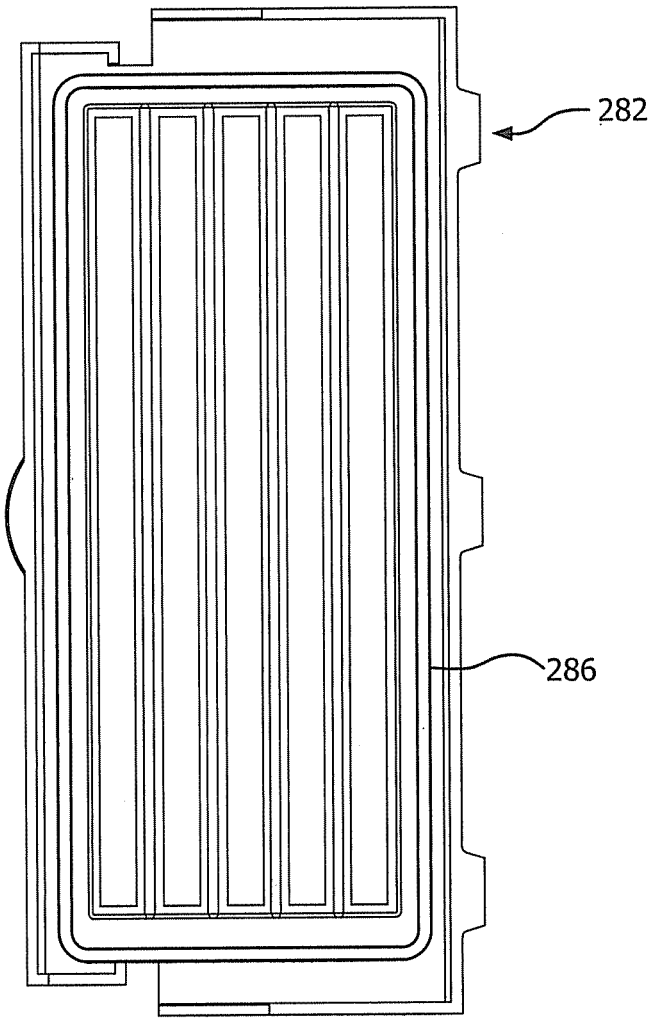

FIGS. 17 and 18 show an additional embodiment of the invention, again including a base shell 280 and a lid shell 282. In this embodiment, a perimeter seal 283 has been incorporated into the clamshell, comprising a lip 284 of the base shell 280 and a lip 286 of the lid shell 282. The lips can form a lip-to-lip butt seal, or the lips can be concentric surfaces having matching tapers, so the sides of the respective lips engage. Optionally, the perimeter seal 283 can be "moisture-tight," which is defined below. In a further embodiment, the perimeter seal may be re-sealable; upon opening and closing of the clam shell package, the moisture-tight seal is re-established. For example, the package can be designed to be moisture tight at least until it has been opened the number of times necessary to access all the wells in the package, one at a time.

Figure 19:
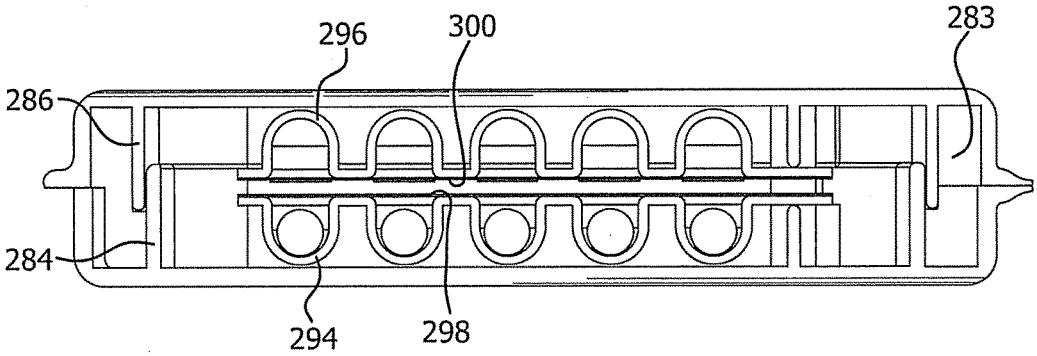
FIG. 19 is a sectional view of another embodiment of the package, when closed, having blister sheets joined to the package and a perimeter seal around the wells.
Figure 20:
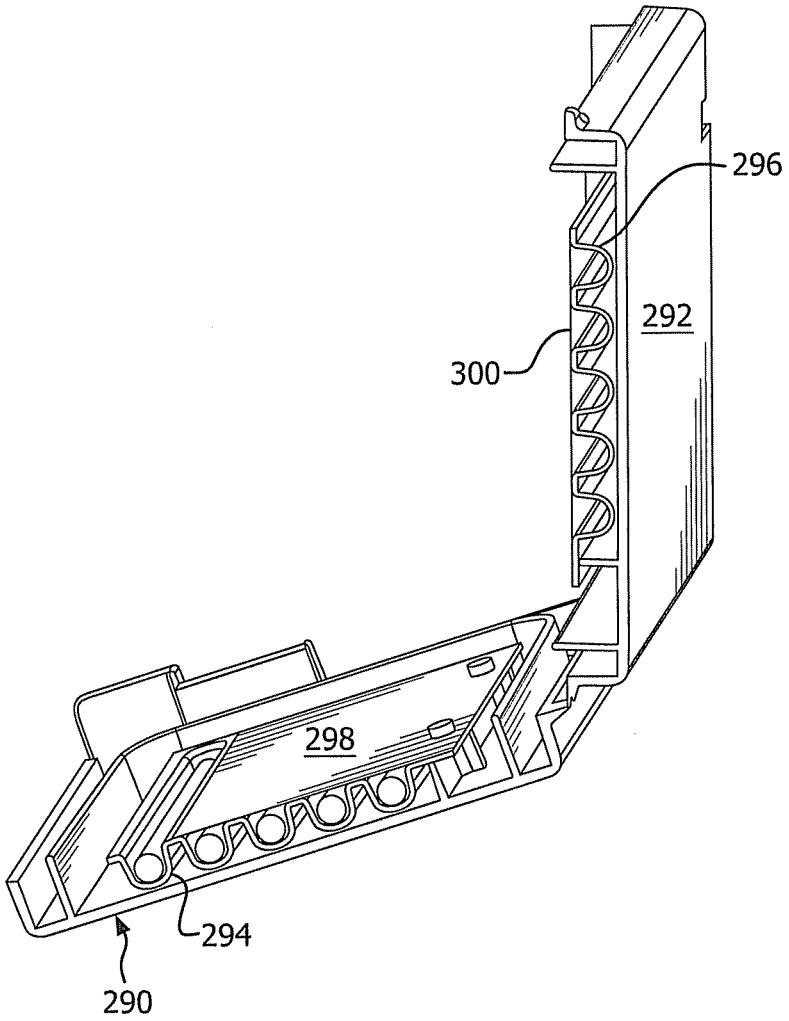
FIG. 20 is a cutaway perspective view of the embodiment of FIG. 19, when open.

FIGS. 19 and 20 show still another embodiment, which can be used as a blister package holder or outer package. The lips 284 and 286 can be concentric surfaces having matching tapers forming a perimeter seal 283, also shown in FIGS. 17 and 18, though this is an optional feature for FIGS. 19-20. FIGS. 19 and 20 also show a base shell 290 and a lid shell 292, respectively supporting and attached to blister sheets 294 and 296 sealed to cover sheets 298 and 300. It is useful to permanently secure the blister sheets 294 and 296 within the package, so the child-resistant closure cannot be circumvented by removing the blister pack from the outer package before dispensing its contents.

The outer package of FIG. 17-18 or 19-20 can be molded as a single piece with an integral hinge and child-resistant closure. In these embodiments, the flexible film optionally does not need to provide any sealing, which would allow for more flexibility in its design and materials. For example a simple, inexpensive paper based material could be used to close off the compartments while the perimeter seal provides the sealing function.

In various embodiments of the invention when a seal is required the wells or other package elements optionally can include a material to remove gases that the product needs to be protected from. This agent could be added separately to the wells or made as an integral part of the base shell and/or lid shell. For example, a multi material molding process could be used to mold one material for the body and a second, joined material in the form of a polymer or plastic material with an active agent entrained within it.

One example of the active agent entrained plastic is a three component composition and method that is disclosed in one or more of the following U.S. Pat. Nos. 5,911,937, 6,214,255, 6,130,263, 6,174,952, 6,613,405 and 6,124,006 incorporated by reference herein. Another example is a two component mixture of active agent and polymer.

In one example a desiccant may be used as the active agent in the entrained polymer. The desiccant can be used to remove moisture from the product and/or the packaged environment. A desiccant can be selected to maintain a specific range of relative humidity. In one example, a molecular sieve desiccant can be used to maintain a relative humidity of less than 10%. In another example, a silica gel desiccant can be used to maintain the relative humidity in the ranges of 10-30% RH (relative humidity) or 30-50% RH or 40-60% RH. The relative humidity can be controlled, for example, by the amount of silica gel incorporated into the polymer.

Other active agents are optionally contemplated, such as oxygen absorbers or materials that release a preservative agent. These can also be incorporated into a three component composition described above as well as a two component composition.

In certain embodiments, a dosage form of a product is provided in at least one of the base or lid wells. The product can be an extruded stick of a composition, a rolled sheet of a composition, a portion of a leaf, ground material and a binding agent, a lozenge, a tablet, a plug, combinations of these types (such as a rolled portion of a leaf), or other forms, without limitation.

As used herein, the term "moisture-tight" in reference to a package, individual well, or other container is defined as follows.

For a complete package having perimeter sealing, "moisture tight" means the moisture ingress into the package is less than about 2500 micrograms of water per day, in another embodiment about 2000 micrograms of water per day, in another embodiment about 1500 micrograms of water per day, in another embodiment about 1000 micrograms of water per day, in another embodiment about 500 micrograms of water per day, in a further embodiment about 300 micrograms of water per day, in yet another embodiment about 150 micrograms of water per day, determined by the following test method: (a) place approximately one gram of molecular sieve in the container and record the weight; (b) close and seal the container; (c) place the sealed container in an environmental chamber at conditions of 80% relative humidity and 22 deg. C. (72 deg. F.); (c) after one day, weigh the container containing the molecular sieve; (d) after approximately two weeks, weigh the container; (e) subtract the first day sample from the value obtained and divide by the number of days to calculate the moisture ingress of the container in units of micrograms of water per day.

For an individual well of a package, "moisture tight" means the moisture ingress into an individual sealed well is less than about 750 micrograms of water per day, in another embodiment about 500 micrograms of water per day, in another embodiment about 250 micrograms of water per day, in another embodiment about 150 micrograms of water per day, in another embodiment about 100 micrograms of water per day, determined by the following test method: (a) place approximately 0.2 gram of molecular sieve (more or less, depending on the well size) in the container and record the weight; (b) close and seal the well and close the container; (c) place the sealed container in an environmental chamber at conditions of 80% relative humidity and 22 deg. C. (72 deg. F.); (c) after one day, weigh the package containing the molecular sieve; (d) after approximately two weeks, weigh the package; (e) subtract the first day sample from the value obtained and divide by the number of days to calculate the moisture ingress of the package in units of micrograms of water per day. The test for a multi-well package can be conducted on an individual well, on all of them, or on any number of wells in between one and all.

Figure 21:
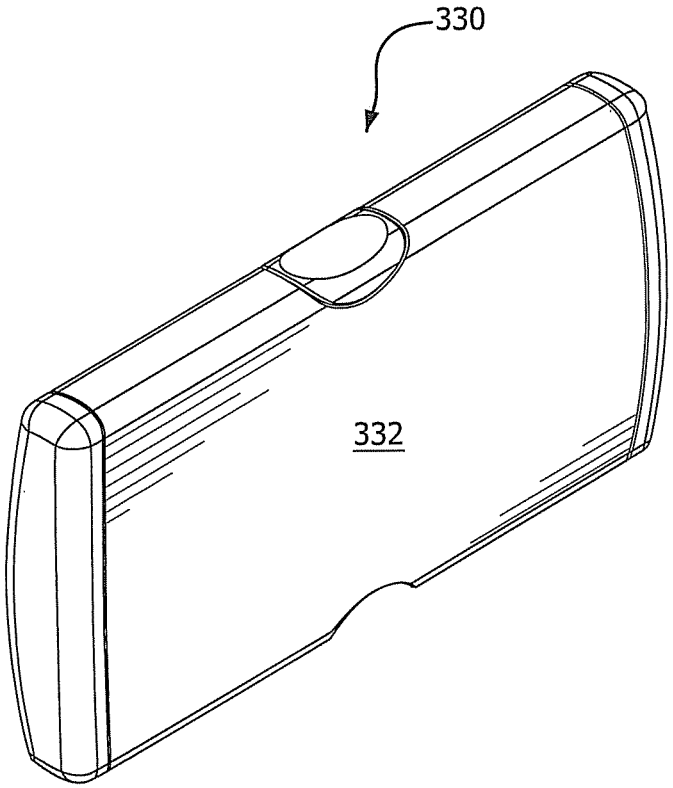
FIG. 21 is a perspective view of an embodiment of the invention.
Figure 22:
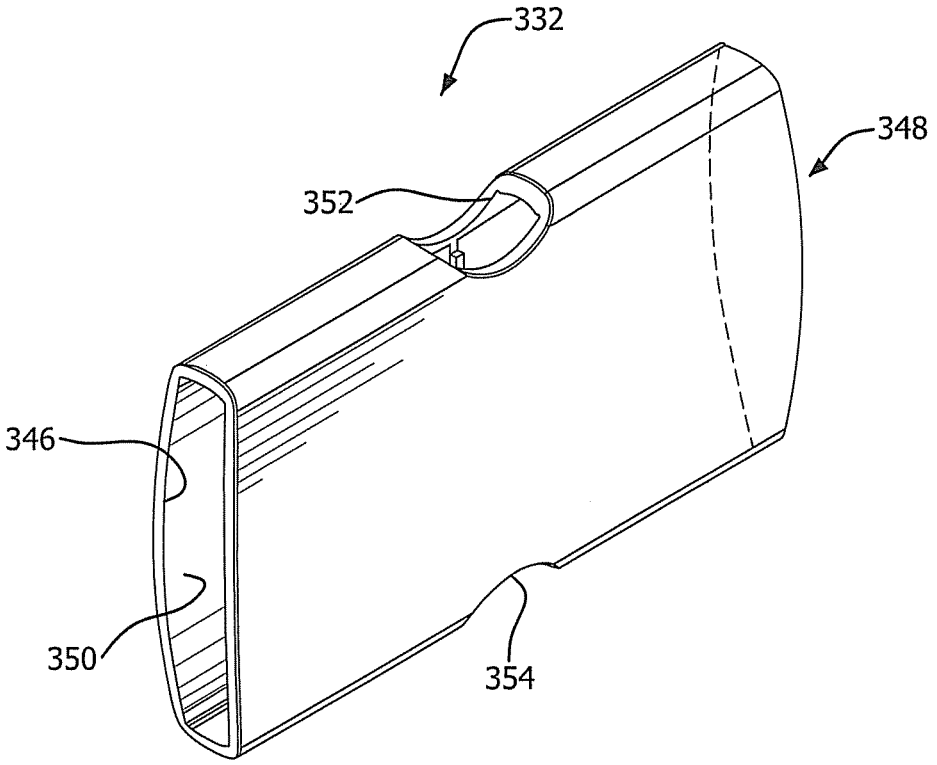
FIG. 22 is a similar view of the embodiment of FIG. 21, showing the shell in isolation.
Figure 23:
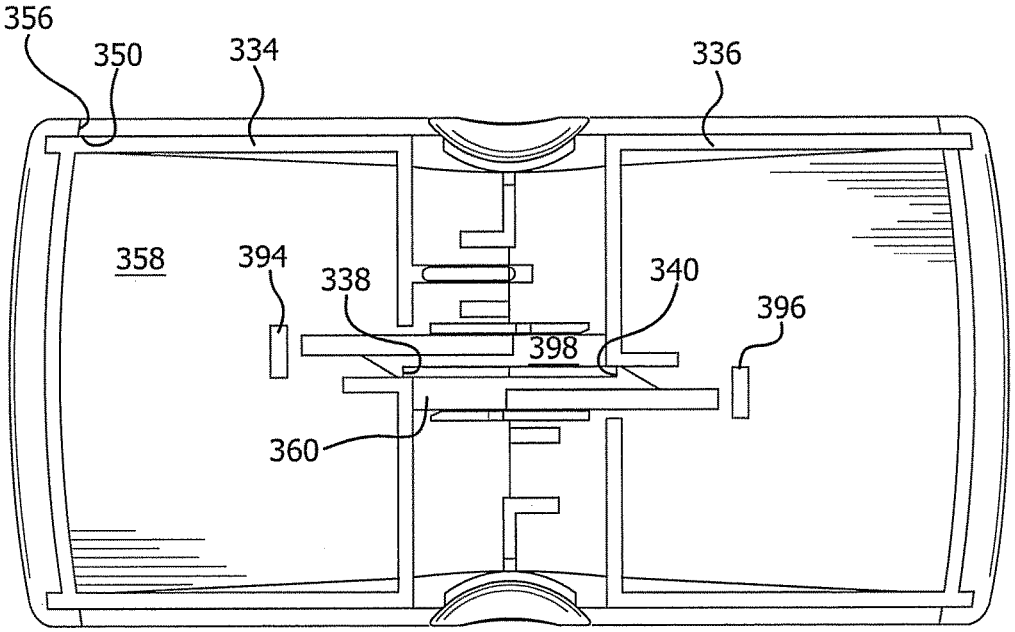
FIG. 23 is a sectional view of the embodiment of FIG. 21, showing details of the drawers.

Referring now to FIGS. 21-23, a child-resistant container generally indicated as 330 is disclosed comprising a shell or housing cover 332, two drawers or product trays 334 and 336, a stop defined by abutments 338 and 340, and a latch, here defined by the first latch 342 and second latch 344.

The shell 332 optionally can have opposed first and second drawer openings 346 and 348. The shell 332 can define a longitudinal passage 350 from the first drawer opening 346 to the second drawer opening 348. In the illustrated embodiment, the shell 332 further can define a first side opening 352, and in this embodiment also a second side opening 354, providing access to the longitudinal passage from outside the shell 332.

The first drawer 334 is slidably received in the longitudinal passage 350 and projects through the first drawer opening 346 when the first drawer 334 is opened, and also, in another embodiment, a little bit when the drawer is closed. In the illustrated embodiment, the first drawer 334 optionally can have its first drawer abutment 340 facing the first opening 350. The first drawer 334 has a gasket 356 and a storage area 358 for containing objects kept in the container 330.

The second drawer 336 is slidably received in the longitudinal passage 350, relatively movable with respect to the first drawer 334, and projects through the second drawer opening 348 when the second drawer is opened and also, in another embodiment, a little bit when the drawer is closed. In the illustrated embodiment, each drawer 334, 336 is identical in shape and function.

The stop defined by the abutments 338 and 340 is located within the passage 350. It is configured to engage the first and second drawers 334, 336 to prevent the first and second drawers from sliding apart past a limit of travel, with respect to the shell. The limit of travel is reached when either of the first and second drawers is open sufficiently to provide access to its contents and the other drawer is closed sufficiently to prevent access to its contents.

In the illustrated embodiment, the stop comprises an abutment 336 of the first drawer 334 facing the first opening 346 and an abutment 340 of the second drawer 336 facing the second opening 348, the first and second abutments 338 and 340 engaging to define the stop when the drawers 334, 336 are moved apart. In the illustrated embodiment, at least one of the abutments 338 and 340, and in this instance each of them, is connected to the corresponding drawer 334 or 336 by a link 360 of one drawer 334 extending toward the other drawer 336 and vice versa the link 362 of the other drawer 336. In the illustrated embodiment, the stop optionally can have a first portion 360 associated with the first drawer 334 and a second portion 362 associated with the second drawer 336. The stop could alternatively be the first and second portions engaged with each other, as illustrated, or the first and second portions engaged with a portion of the shell, or the first and second portions engaged with a portion of the latch, in alternative embodiments.

The latch, here defined by the first latch 342 and the second latch 344, is normally biased, here by the resilience of the first and second push button gaskets 364 and 366 deformed against the shell 332, to latch and seal the first and second drawers 334, 336 closed as illustrated in FIGS. 21-24. The latch such as 342 is operable against its normal bias to unlatch at least one drawer 334 or 336. In the illustrated embodiment, the latch comprises a first latch 342 engaging the first drawer 334 and a second latch 44 engaging the second drawer 336. Alternatively, a one-part latch can be devised for engaging both drawers 334, 336, either simultaneously or alternatively. The first latch 342 optionally can have a first latch abutment 368 facing the first drawer opening 346, and the first latch 342 includes part of an unlatching mechanism described below, which in this embodiment is a ramp 370, and in this embodiment more precisely a pair of ramps 370 and 372, on the latch 342.

In this embodiment, the first and second latches 342 and 344 are at least partially within the longitudinal passage 350 and respectively accessible through the first and second side openings 352 and 354, respectively for unlatching the first and second drawers 334, 336. The second latch 344 optionally can have a second latch abutment 374 facing the first drawer opening 346.

In the illustrated embodiment the latch 344 is operated using a push button, here opposed push buttons 376 and 378.

In the illustrated embodiment, the first and second latches 342 and 344 are identical in shape.

Each drawer 334, 336 and the corresponding latch 342, 344 define an unlatching mechanism 380, 382. In the illustrated embodiment, the unlatching mechanism 380, 382 includes a ramp 370 or 372 on the latch 342 or 344 and a ramp (here, the ramps 384 and 386) on a link 388 projecting from the drawer 334 that engage to deflect the drawer abutment 390 transversely away (behind the plane of FIG. 24) from the latch abutment 368.

In the illustrated embodiment, the first drawer abutment 390 and first latch abutment 368 are positioned to engage each other when the first drawer 334 is closed and the latch 342 is normally biased to latch the first drawer 334 closed. Similarly in this embodiment, the second drawer abutment 392 and second latch abutment 374 are positioned to engage each other when the second drawer 336 is closed and the latch 344 is normally biased to latch the second drawer 336 closed.

In the illustrated embodiment, the first and second latches 342 and 344 are configured to unlatch by traveling transversely toward each other within the passage 350, disengaging one of the first and second drawer abutments 390, 392 from the corresponding latch abutment 368 or 374 when both latches 342 and 344 are operated.

In the illustrated embodiment, the first drawer 334 and the latch 342 are configured to unlatch the first drawer 334 only when both pushing the first drawer 334 further closed to engage an unlatching mechanism 380 and operating the latch 334 to unlatch the first drawer 334. In the illustrated embodiment, the second drawer 342 and the latch 344 similarly are configured to unlatch the second drawer 336 only when both pushing the second drawer 336 further closed to engage a second unlatching mechanism 382 and operating the latch 344 to unlatch the second drawer.

The unlatching mechanism such as 380 of the present embodiment works as follows.

Figure 24:
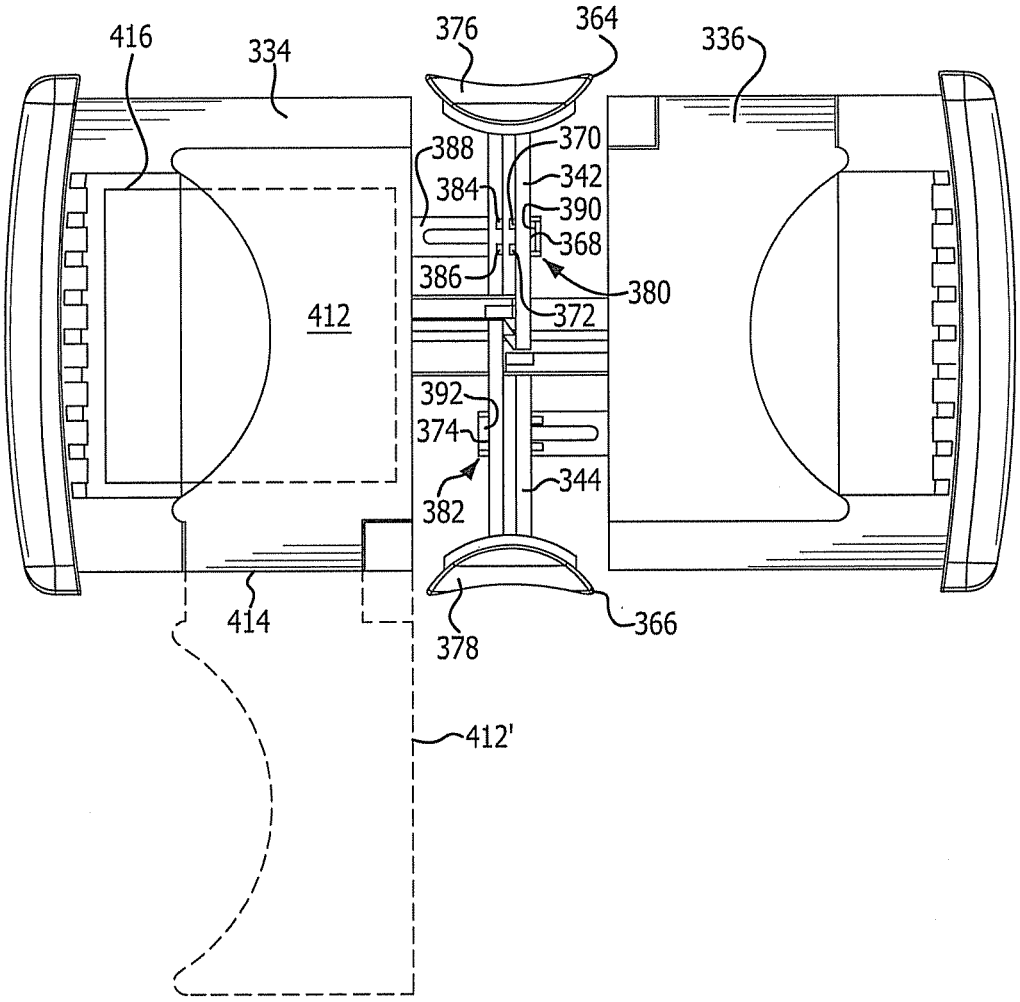
FIG. 24 is a plan view of the embodiment of FIG. 21 with the shell removed, showing details of the latches and drawers. The ramps 70, 72, 84, and 86 are shown in phantom.
Figure 25:
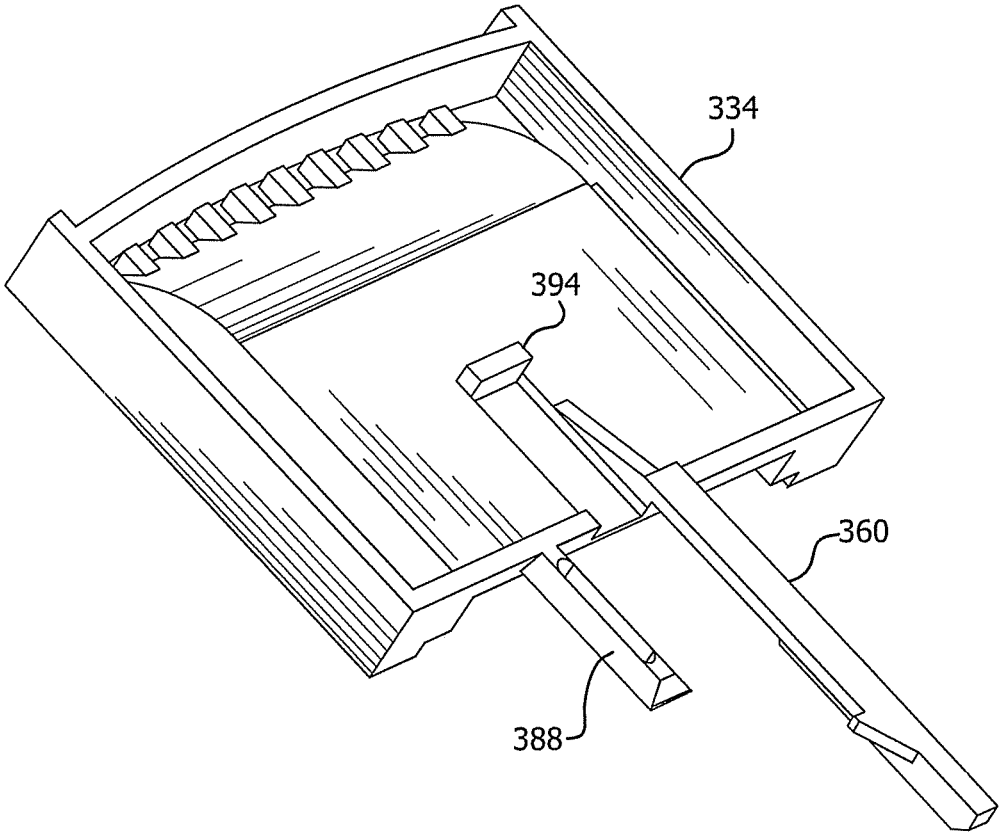
FIG. 25 is an isolated perspective view of a drawer of the embodiment of FIG. 21, primarily showing the bottom of the drawer.
Figure 26:
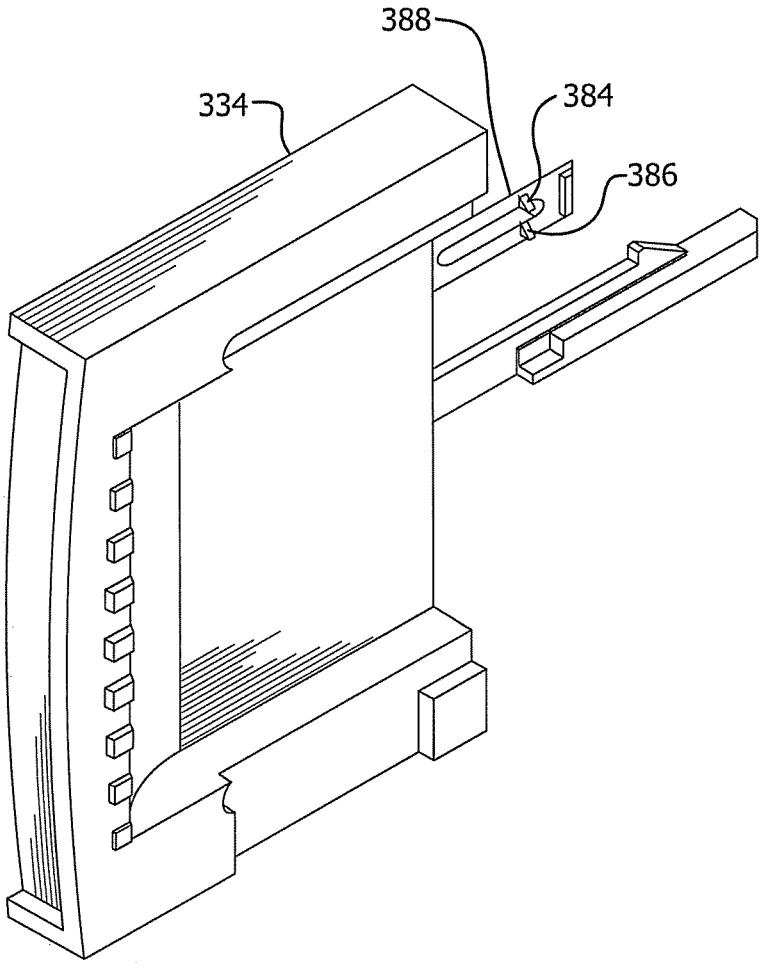
FIG. 26 is an isolated perspective view of a drawer of the embodiment of FIG. 21, primarily showing the top of the drawer.
Figure 27:
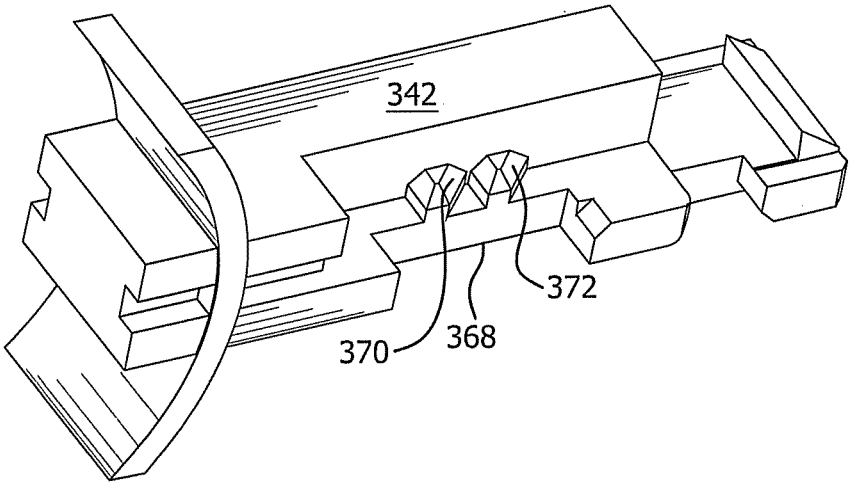
FIG. 27 is an isolated perspective view of one side of a latch according to the embodiment of FIG. 21.
Figure 28:
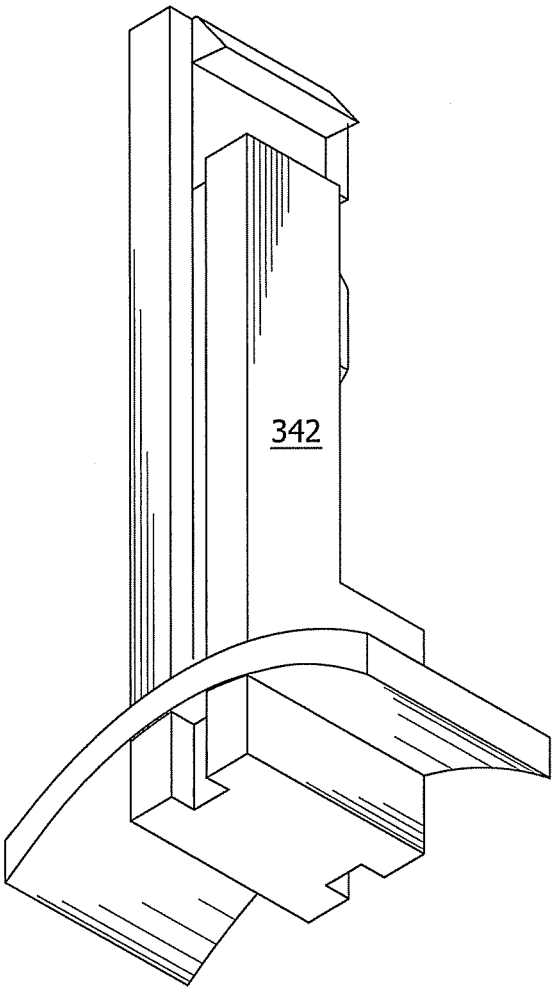
FIG. 28 is an isolated perspective view of the other side of a latch according to the embodiment of FIG. 21.
Figure 29:
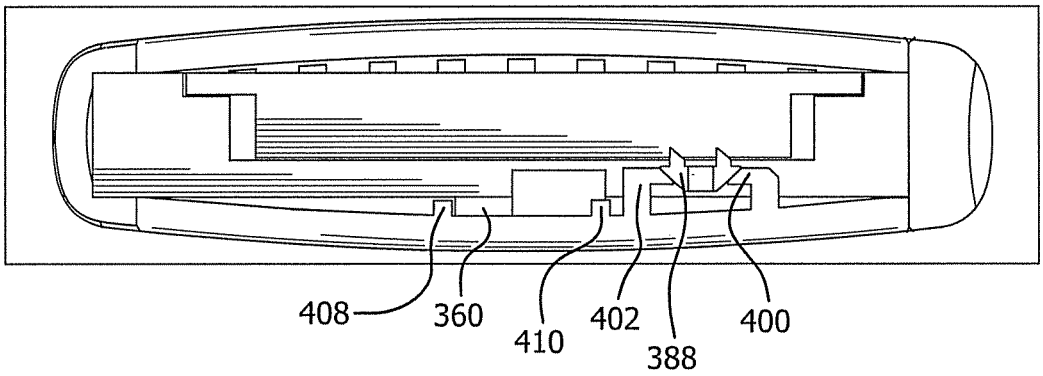
FIG. 29 is a transverse section of the embodiment of FIG. 21.
Figure 30:
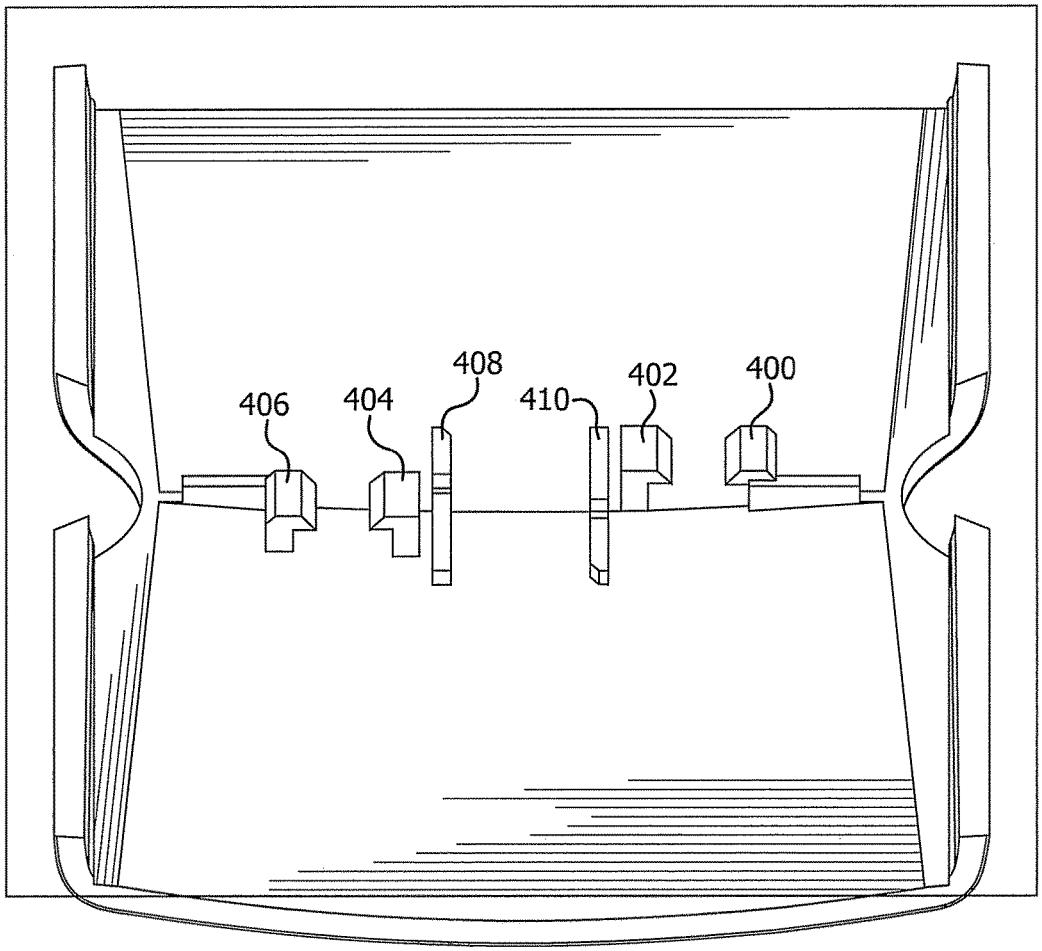
FIG. 30 is a perspective cutaway view of the embodiment of FIG. 21, showing the interior wall.
Figure 31:
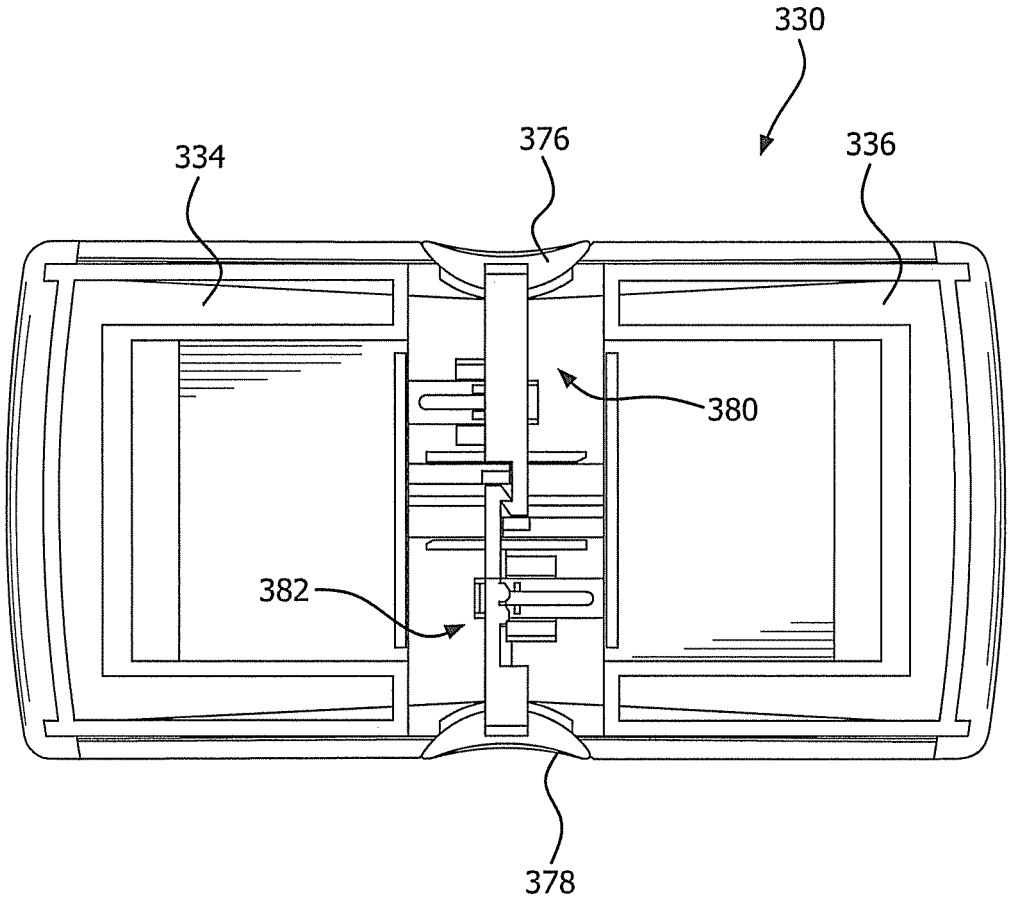
FIG. 31 is another section of the embodiment of FIG. 21, showing more interior details.

In the illustrated embodiment, the ramps 370 and 372 on the latch 342 and the corresponding ramps 384 and 386 on the drawer 334 are normally longitudinally displaced when the drawer 334 is closed, as shown in FIG. 24 (where the ramps are all underlying structure) and are longitudinally aligned in engaging relation by moving the ramps 384 and 386 to the right in FIG. 24 when the drawer 334 is pushed further closed.

In the illustrated embodiment, a first stop 394 (in drawer 334) and a second stop 396 (in drawer 336) respectfully limit the travel of the links 360 and 398 to prevent the drawers 334, 336 from being simultaneously pushed further closed sufficiently to engage both the unlatching mechanism 380 of the first drawer 334 and the unlatching mechanism 382 of the second drawer 336, thereby only allowing one of the first and second drawers to be opened at a time.

The shell 332 of the illustrated embodiment has guides 400 and 402 that receive the link 388 of the drawer 334 when the unlatching mechanism 380 is engaged and the link 388 is deflected, and similar guides 404 and 406 that receive the link of the drawer 336 when the unlatching mechanism 382 is engaged and the link of the drawer 336 is deflected, in each case to guide the drawer as it is opened. The shell 332 also has a guide 408 to guide the drawer link 360 and a guide 410 to guide the other drawer link 398.

The drawers such as 334 can further include partial covers such as 412. In an embodiment, the partial cover 412 can be molded as an integral part of the drawer 332, with an integral hinge 414, while in the orientation 412' shown in phantom in FIG. 24. The partial cover 412' can then be folded over and optionally secured to the body of the drawer 334 by a catch or similar arrangement. Also or instead, the insertion of the drawer 334 into the shell 332 during assembly of the container 330 with the partial cover 412 in the closed position shown in full lines in FIG. 24 can capture the partial cover 412 in its closed position. The partial covers such as 412 limit access to the stack 416, encouraging the user to remove one sheet 416 at a time from the top of a stack of the sheets 416.

A further description of the illustrated embodiment follows.

The illustrated embodiment includes a package 330, useful for example for solid oral dosages in a bulk arrangement so as to limit the number of solid oral dosages that are presented to a user. The bulk package 330 optionally can be portable, lightweight and easy to use. The package 330 as illustrated has an effective child-resistant closure, as a small child will find it difficult to press the push buttons 376, 378 and push a drawer into the package at the same time. Also, the double drawer feature with only one operable at a time, limits the amount of contents to which the user has access at a given time. The package 330 optionally can also help to create an emotional bond between the user and the product. A package that is fun to operate and has an appealing tactile element is regarded here as creating such an emotional bond.

The illustrated embodiment includes a bulk package for delivering solid oral dosages to a user. The solid oral dosages may include, but are not limited to: edible films, tablets, lozenges and capsules. In one embodiment, the product is an edible film. In an embodiment, the edible films are rectangular in shape; the approximate dimensions can be 25 mm×35 mm in size for example. The bulk package of the present illustrated embodiment can be substantially a rectangular parallelepiped, as an example: the illustrated embodiment is essentially a rectangular parallelepiped with rounded edges and corners, and is relatively thin so that the package may be readily carried in a pocket or handbag. The edible films are stacked in trays located within the bulk package. The bulk package incorporates two trays, one located in each end of the package.

The trays slide out from each end of the package. In an embodiment, each tray holds up to 25 edible films and more preferably, approximately 10 edible films per tray. The bulk package shown in FIG. 21 optionally can have 20 edible film pieces: 10 pieces per tray.

To open the package, two buttons 376 and 378, located in the center of the package, are used to slide out one of the trays. The buttons are attached to latches 342, 344 that control the child-resistant mechanism. To open the package, the buttons are pressed and held in while simultaneously one of the trays (or drawers) is pushed inward about 1 to 2 mm. Once pushed inward, the tray is released, causing the tray to move outward from the bulk package housing. Once the tray is released, the user may manually slide the tray further open to access the product.

The package is designed such that only one tray may be accessed at a time. When one tray is opened to the user, the other tray is locked within the package.

After the tray is opened, the user may release the two push buttons 376 and 378. When released, the push buttons move the latches outward due to spring back of the compliant gasket, returning to their home positions. To close the package, the user can slide the opened tray back into the housing cover. In the illustrated embodiment, the tray can be flush with the housing cover when fully seated in the package. It is possible to push the tray beyond flush, about 1 to 2 mm. When in the closed position, the tray is again locked into the package and cannot be opened again until the above sequence is repeated.

In the illustrated embodiment, the bulk package is composed of five parts: a housing cover, two identical side buttons with latches and two identical product trays.

The bulk package is designed to protect the product from exposure to moisture. The bulk package as illustrated optionally can have moisture tight seals that are formed between the product trays and the housing cover, and also optionally can have moisture tight seals that are formed between the push buttons and the housing cover. The bulk package re-establishes these moisture-tight seals during use life (after the trays have been opened and closed). The re-sealable moisture-tight seals are designed for up to 50 open/close cycles per tray. Moisture-tight is defined as having a moisture ingress rate of less than 2,000 micrograms per day, preferably less than 1,500 micrograms per day, under the conditions of 22° C./80% RH (relative humidity), determined by the following test method: (a) place approximately one gram of molecular sieve in the container and record the weight; (b) close the resealable mechanism; (c) place the sealed container in an environmental chamber at conditions of 80% relative humidity and 22° C.; (c) after one day, weigh the container containing the molecular sieve; (d) after approximately two weeks, weigh the container; and (e) subtract the first day sample from the value obtained and divide by the number of days to calculate the moisture ingress of the container in units of micrograms of water.

The tray assembly is composed of three parts: (1) the product tray, (2) a compliant gasket material at one end (also used as a button) and (3) a product lid to partially restrict access to the product.

The product tray serves as a reservoir to hold the edible film in a stacked arrangement. The product tray optionally can have a sloped region to facilitate the removal of one piece of edible film from the stack. The sloped region helps to separate the top piece of film from the stack. Typically, the user places a finger on the top of the edible film stack and slides the top piece toward the sloped region. The product tray may be composed of a single material (i.e., polypropylene or polyethylene) or may incorporate an active-polymer (i.e., a desiccant plastic) to control the moisture level in the product. In one embodiment, the product tray is manufactured in a 2-shot injection molding process: the outer portion is molded of a thermoplastic resin (i.e., polypropylene or polyethylene) and the interior portion (the sloped region) is molded out of desiccant plastic. Desiccant plastic material is described, for example, in U.S. Pat. Nos. 5,911,937; 6,080,350; 6,130,263; 6,174,952; 6,214,255; 6,486,231; and 7,005,459, incorporated by reference here.

A compliant gasket material is positioned on one end of the product tray. There are two projections that are located on the side opposite of the gasket material. Referring to FIG. 24, the shorter projection optionally can have a slot in the middle of the projection. The longer projection optionally can have a harpoon-like feature along one side of the projection. The shorter projection interacts with the latching mechanism. The longer projection extends into the opposing tray and prevents both trays from being opened at the same time.

The product tray optionally can have a lid that partially extends over the top of the tray. The lid may be manufactured as a separate component or manufactured integral to the product tray. As an integral component, the lid may be hinged to the product tray. In one embodiment, the product tray and lid are molded in a single injection molding process. Prior to product filling, the lid is not assembled over the top of the tray. The lid may be hinged in an 'open' position. After product is filled into the tray, the lid may be rotated closed and locked into position. Once closed, the lid may not be removed.

The gasket serves two functions: (1) provides a moisture-tight seal between the housing cover and the product tray and (2) provides a spring-back force when the user pushes product tray inward. During package operation, the user applies an inward force to the tray on the gasket material.

The gasket may be a separate component or manufactured with the product tray in an integral manner. In one embodiment, the gasket is molded in a 2-shot injection molding process with the product tray. The gasket may be composed of a thermoplastic elastomer (TPE). Suitable TPEs are materials with a good moisture vapor transmissions rates and materials that readily bond (are compatible with) the thermoplastic resin used for the product tray.

The push button latches and product trays are assembled into the housing cover. The push button latches each have a hook-feature on their distal end. When the push buttons are assembled into the housing cover, the hooks interlock together and prevent the push button latches from being removed from the package. The push buttons are an integral part of the child-resistant mechanism in the package. In the closed position, when the push buttons are NOT pressed, the latches prevent the product trays from begin opened. The shorter slotted tab in the product tray optionally can have a projection along the distal end and is assembled over the latch. The interference between the projection and the latch prevent the product tray from opening.

The housing cover can be composed of one material. In a preferred embodiment, the housing cover may be manufactured in one part using an injection molding process. The material used for the housing cover optionally can provide a good barrier to moisture and to UV light to protect the product within the package. The material optionally can also be dimensionally stable since the there are features in the housing cover that interact with other aspects of the bulk package to assist operation of the package. Suitable materials include polypropylene (PP), high-density polyethylene (HDPE), cyclic olefin copolymer (COC) etc.

The interior, bottom surface of the housing cover optionally can have two channels that project out from the surface. These channels are used to capture the shorter, slotted tab of the product tray.

The product tray's slotted tab optionally can have a set of cleats midway along the top surface. When the push button latches are pressed inward, the cleats ride along the latch. At the same time, one of the product trays is pressed inward. The latch bottom surface optionally can have corresponding cleats so that the slotted tab is deflected downward approximately about 2 to 3 mm. When the push button tabs are fully depressed, the slotted tab is deflected downward so that the tab is aligned with one of the channels in the housing cover. When the product tray is released, the product tray slides outward from the package; during this outward motion, the slotted tab is captured by one of the channels in the housing cover.

The product tray can then be pulled out of the package, until the longer tab on the product tray reaches the end of travel. The end of travel occurs when the harpoon feature of one product tray contacts the harpoon of the opposing product tray. The maximum distance that a product tray can be opened is defined by the harpoon position.

The push button latches can be composed of two components: (1) a push button that forms a moisture-tight seal with the housing cover and (2) a movable latch that is used to release the product trays. The push button latches may be made of two parts and assembled. In a preferred embodiment, the push button latches are made in a 2-shot injection molding process. The push buttons are made of a thermoplastic elastomer with similar material requirements as the Gasket on the product tray.

The push button latches are pushed together inward. In the present embodiment, the latches move approximately 4 mm inward. A set of cleats on the bottom surface of the latches engage a corresponding set of cleats on the slotted tab on the product tray, causing the slotted tab to deflect downward. This allows the slotted tab to fit into a channel in the housing cover and enables one of the product trays to open outward.

FIGS. 32 to 39 illustrate an embodiment of a package 414 having a first shell portion 416, a second shell portion 418 (FIG. 40), an insert 420, a first and second latch 422*a*, 422*b* (FIG. 34), and a button assembly 426. According to an embodiment, the first and second shell portions 416, 418 and the insert 420 may generally have the same or similar construction and features as previously discussed with respect to at least the first and second shell portions 42, 44 and insert 78. Additionally, according to certain embodiments, the first and second shell portions 416, 418 may be joined by a variety of integral or non-integral hinges, such as, for example, a double hinge, a double-fold hinge, flat-top hinge, butterfly hinge, or pinned hinge, among others. Additionally, the package 414 may include a sealing arrangement as previously discussed, including, but not limited to, the sealing arrangements discussed with respect to FIGS. 1 to 5. Ancillary seals, such as those made of an elastomeric material, may also be incorporated to form face or side seals in addition to, or in lieu of, seals created by the first and/or second closed lips.

Figure 37:
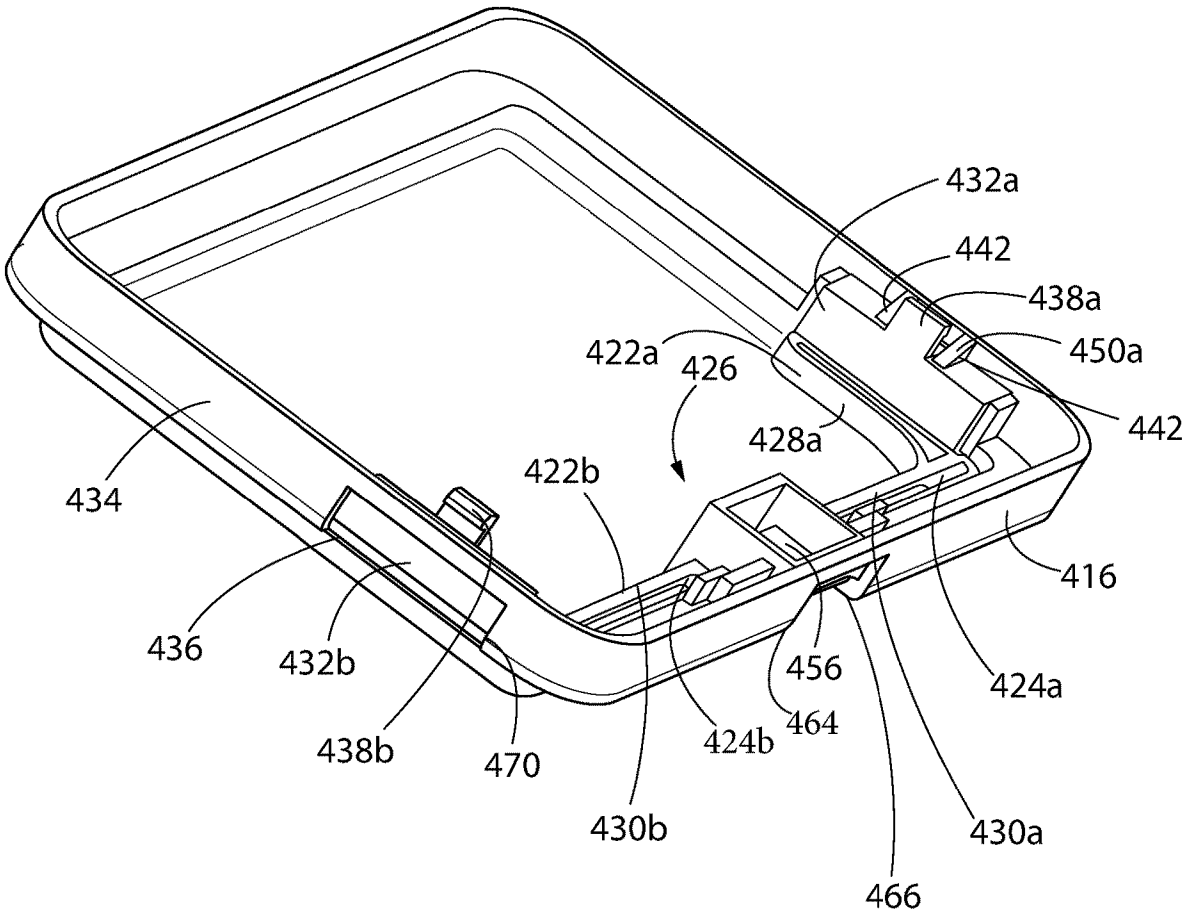
FIG. 37 is a perspective view of the first shell portion shown in FIG. 34, with the two latches and a center button being in an open position.
Figure 38:
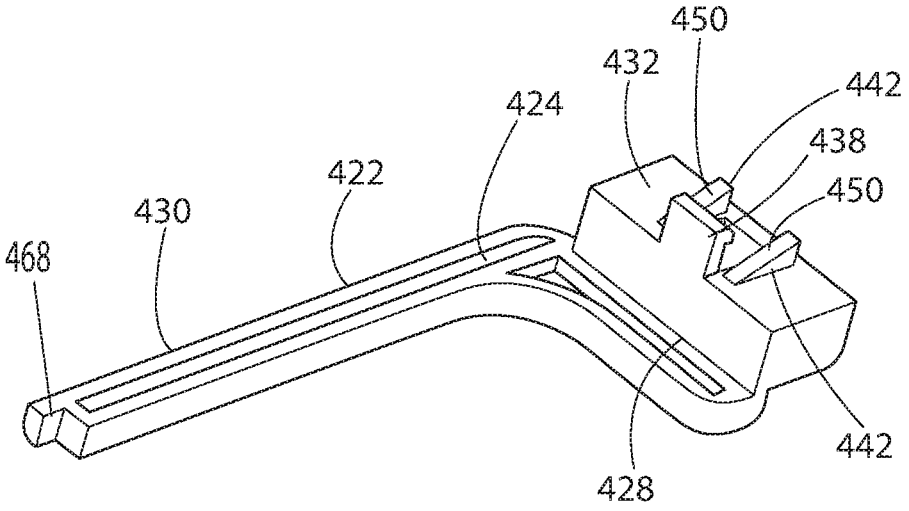
FIG. 38 is a perspective view of a latch for use with the package illustrated in FIG. 32.
Figure 40:
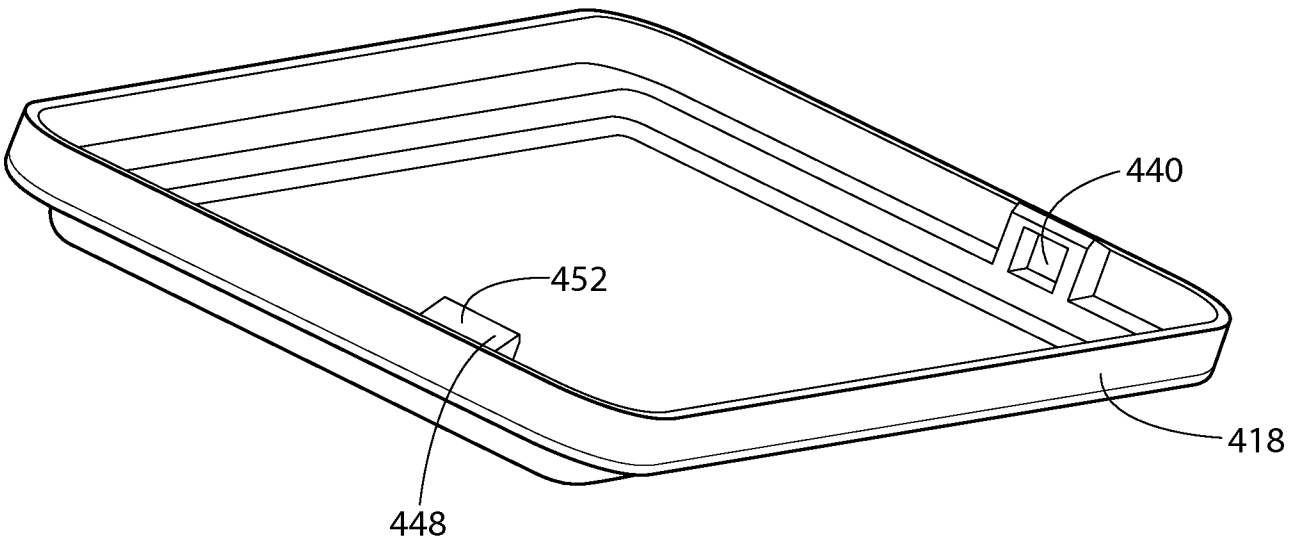
FIG. 40 is a perspective bottom view of a second shell portion for use with the embodiment of the package illustrated in FIG. 32.

As shown in FIG. 38, according to an embodiment, the first and second latches 422*a*, 422*b* include a first leg 428 and a second leg 430. According to an embodiment, the first and second legs 428, 430 are joined at an angle. The first leg 428 includes, or is attached to, an actuator portion 432. The base sidewall 434 includes an opening 470 (FIG. 37) to allow for the placement and/or protrusion of at least a portion of the actuator portion 432 so that a user may press the actuator portion 432 to unlock a closed package 414. According to certain embodiments, a latch abutment 438 extends from the actuator portion 432. The latch abutment 438 may be a hook that is configured for engagement with a catch 440 (FIG. 40) that is in, or attached to, the second shell portion 418, as shown in FIG. 40.

The first leg 428 of the actuator portion 432 may also include at least one latch ramp 442 (FIGS. 37-38). The latch ramps 442 may extend from a top surface of, or from within, the actuator portion 432, and may be positioned on either side of the latch abutment 438, among other locations. However, the latch ramp 442 may be located at a variety of locations, including on the first or second leg 428, 430. The latch ramp 442 is configured to engage at least one lid ramp 448 on the second shell portion 418 when the latch 422 is moved from a locked or rest position to an open position. The latch ramp 442 may have an angled surface 450 that is configured to mate with an angled surface 452 of the lid ramp 448 to at least partially raise the second shell portion 418 as the latch ramp 442 is displaced by a user displacing the actuator portion 432. As shown in FIG. 40, according to an embodiment, the angled surface 452 of the lid ramp 448 may be a sidewall of the catch 440.

Figure 32:
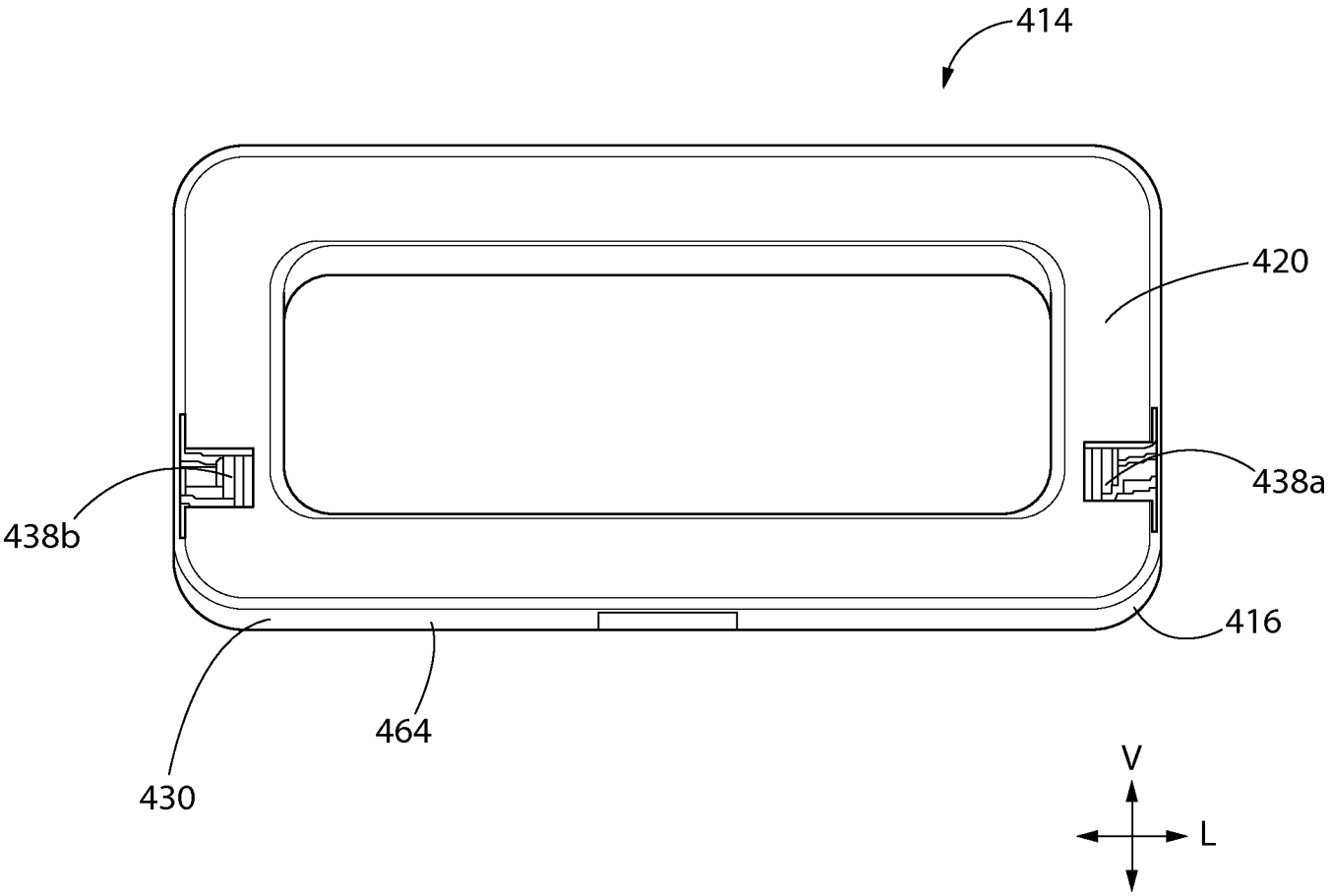
FIG. 32 is a perspective view of an embodiment of a package with the second shell portion not shown, the package having two latches and a center button.
Figure 33:
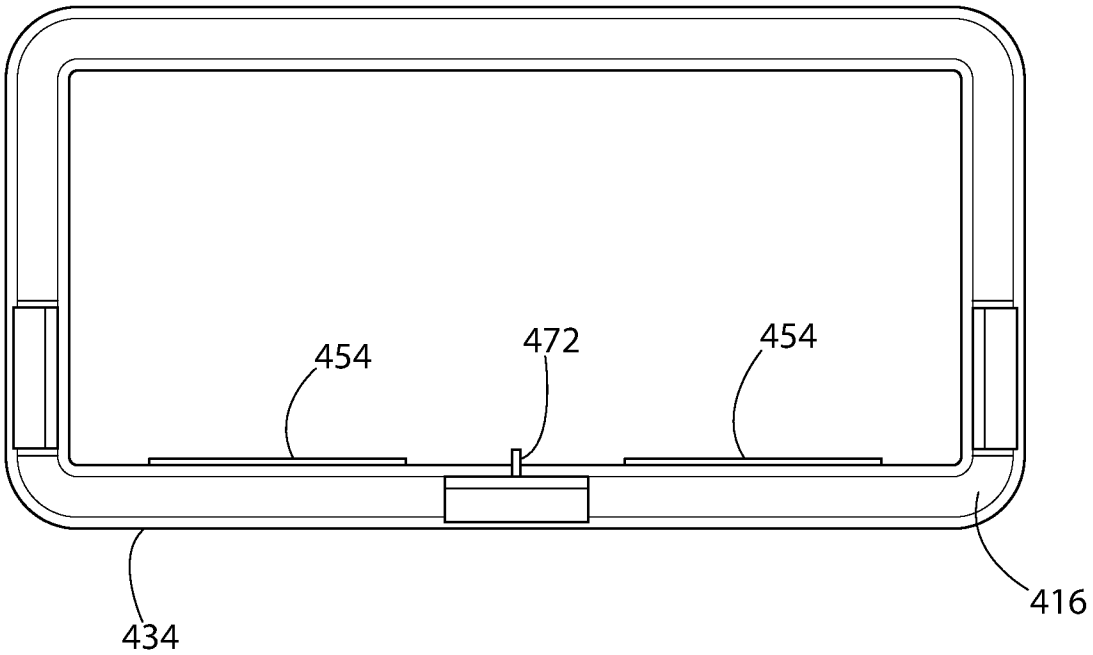
FIG. 33 is a top view of the first shell portion of the package illustrated in FIG. 32.
Figure 34:
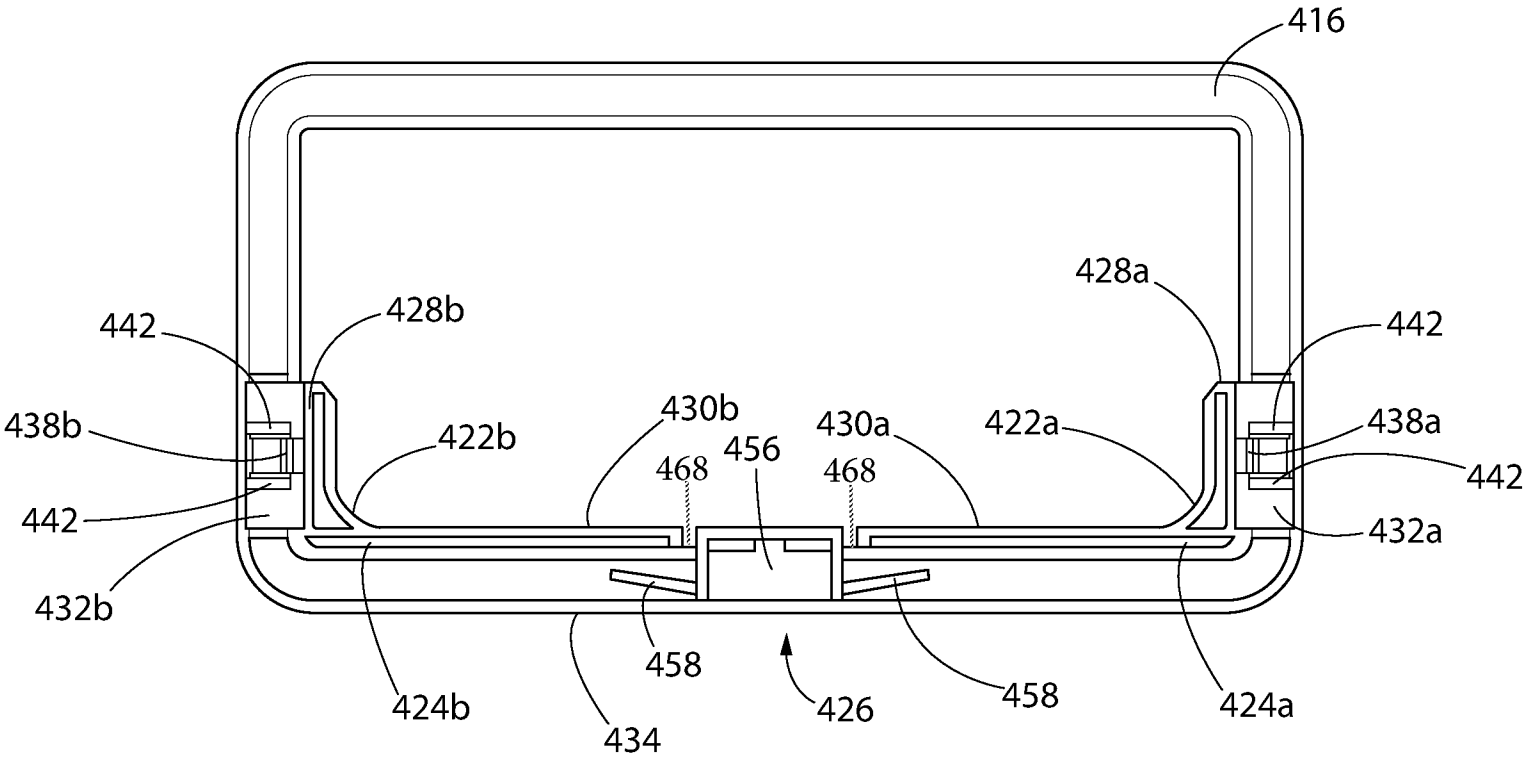
FIG. 34 is a top view of the first shell portion shown in FIG. 33 with two latches and a center button shown in a locked or rest position.
Figure 35:
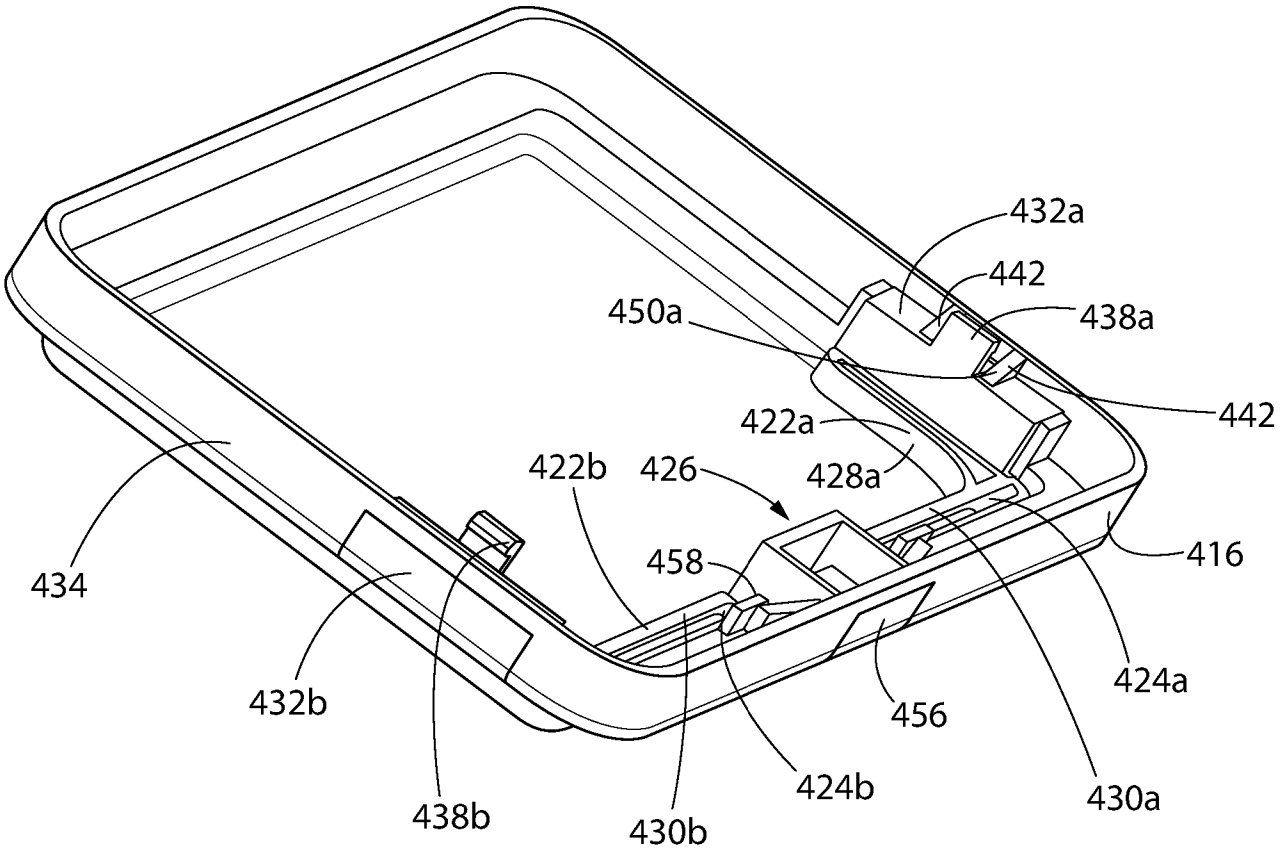
FIG. 35 is a perspective view of the first shell portion shown in FIG. 34, with the two latches and a center button being in a locked or rest position.

The first and second legs 428, 430 may also include openings 424 or slots that guide the movement of the latch 422 in the "L" direction (as indicated by FIG. 32), when the actuator portion 432 is displaced by a user to displace the latch abutment from engagement with a catch 440, and thereby unlock the package 414. The openings 424 may mate with one or more guides 454 (FIG. 33) that project from the first shell portion 416 or insert 420. Alternatively, according to an embodiment, the first or second legs 428, 430 may include protrusions that mate with recesses or grooves in the first shell portion 416 or insert 420 to guide the movement of the latch 422.

As previously discussed, according to certain embodiments, the latches 422*a*, 422*b* may also include, or be attached to, a spring, such as a leaf spring, among others, that biases the latch 422 in the locked or rest position.

The package 414 show in FIGS. 32 to 40 also includes a button assembly 426. According to an embodiment, the button assembly 426 (FIG. 39) includes a button 456, at least one spring 458, and at least one tab 460. According to an embodiment, the button assembly 426 is integrally molded. The button assembly 426 can be positioned at a variety of locations, including, for example, about a front base sidewall 464 (FIG. 32) of the first shell portion 416, among others. The front base sidewall 464 includes an opening 466 to allow for the placement and/or protrusion of at least a portion of the button 456 in/out of the opening 466.

Figure 39:
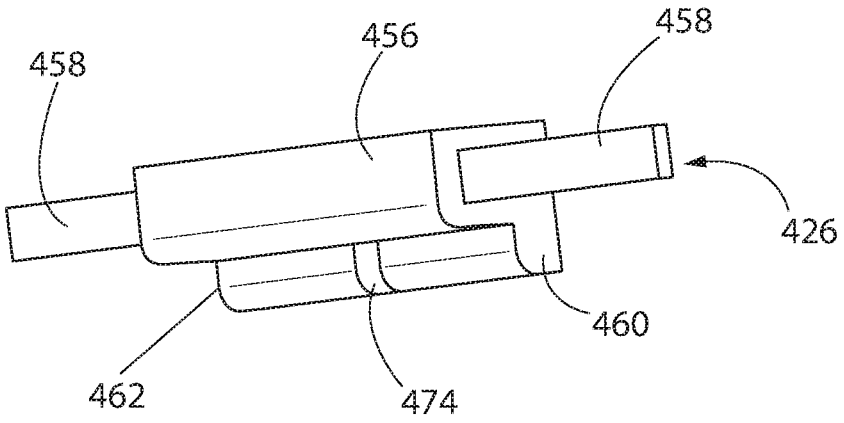
FIG. 39 is a perspective view of a portion of a button assembly for use with the package illustrated in FIG. 32.

According to embodiments, the at least one tab 460 extends from the button 456 (FIG. 39). Additionally, according to an embodiment, one or more cavities 462 are formed in the beneath or within the button 456 that are adjacent to the tab 460. When the button assembly 426 is in a closed position, the tab 460 is configured to prevent the movement of the latches 422. More specifically, when the button assembly 426 is in a closed position, the tab 460 is generally aligned with the end portions 468 (FIG. 34) of the second legs 430 of the latches 422 to prevent the latches 422 from begin inwardly displaced in the "L" direction, such as when actuator portions 432 are pressed inwardly in the "L" direction by a user. Additionally, according to certain embodiments, the springs 458 of the button assembly 426 may abut against a wall of the first shell portion 416 and bias the button assembly 426 in a closed position. Further a bottom assembly guide 472 (FIG. 33) may mate with a slot 474 in the button assembly 426 to guide the displacement of the button assembly 426 from a closed position to an open position.

Figure 36:
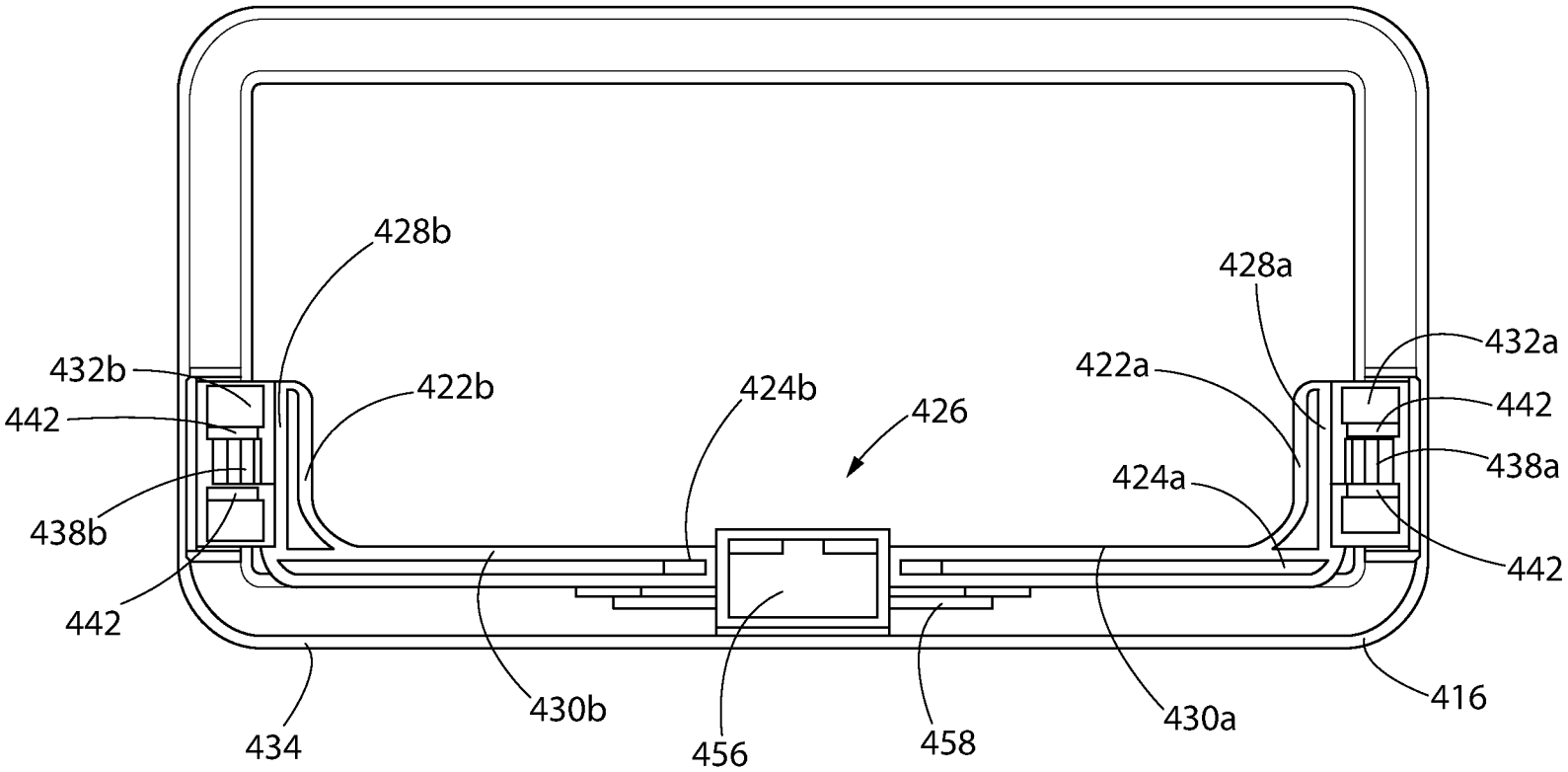
FIG. 36 is a top view of the first shell portion shown in FIG. 33 with two latches and a center button shown in an open position.

To unlock a closed and locked package 414, a user displaces the button 456 inward in the "V" direction (as indicated by "V" in FIG. 32) to move the button assembly 426 to an open position (FIG. 36). The displacement of the button 456 from the closed position to an open position causes the displacement of the tab 460 and cavity 462. Moreover, when the button assembly 426 is moved to an open position, the tab 460 is moved away from the end portions 468 of the second legs 430, and the cavity 462 is aligned with the end portions 468 of the second legs 430. With the button assembly 426 in an open position, the user may unlock the package 414 by inwardly displacing the actuator portions 432 in the "L" direction. However, as the button assembly 426 may be biased in the closed position, the displacement of the latch 422 may require that the user continue depressing the button 456 of the button assembly 426 while also depressing the actuator portions 432.

When the package 414 is in a closed and locked position, the latch abutment 438 is in a locking engagement with the catch(es) 440. As the user depresses the actuator portion 432 and the latch 422 moves in the "L" direction, the latch abutment 438 is removed from the catch 440 and the end portion 468 (FIG. 34) moves into the cavity 462 (FIG. 32). Additionally, the displacement of the actuator portion 432 causes the angled surface 450 of the actuator portion 432 to engage the angled surface 452 (FIG. 40) of the lid ramp 448, causing the second shell portion 418 to be raised from the first shell portion 416. The engagement of the latch 422 and ramps 442, 448, which need not be used with a package 414 having a button assembly 426, and vice versa, may also at least partially break or compromise a seal formed in an inner area of the package 414, thereby making the package 414 easier to open.

It should be noted that the term "comprising" does not exclude other elements or steps and that "a" or "an" do not exclude a plurality.

The invention claimed is:

1. A package comprising:

a first shell portion;

a second shell portion that removably affixes to the first shell portion to move the package between an opened position and a closed position, the second shell portion having first and second catches and at least one lid ramp;

first and second latches that respectively engage said first and second catches when the package is in the closed position for releasably latching the first shell portion and second shell portion together, the first and second latches each having an actuator portion adapted to be displaced by a user to release the first and second latches from engagement with the first and second catches, each of the first and second latches also including a latch ramp, the latch ramp configured to engage the lid ramp when the actuator portion is displaced to at least partially raise the unlatched second shell portion to facilitate moving the package from the opened position to the closed position; and a button assembly on said second shell portion that interfaces with the first and second latches, said button assembly requiring activation simultaneously with said displacement of the first and second latches by the user, said button assembly including a button, a tab, and a cavity, said button assembly adapted to be displaced from a locked position to an unlocked position, said tab positioned to be adjacent to an end portion of said at least one latch when said button assembly is in the locked position to prevent the displacement of said first and second latches, said button assembly configured to align the cavity with the end portion of said first and second latches when said button assembly is in an unlocked position to allow the displacement of said first and second latches.

2. The package of claim 1, further comprising a hinge that pivotally joins the first shell portion and the second shell portion, wherein the first shell portion and the second shell portion pivot about the hinge to move between the opened position and the closed position.

3. The package of claim 1, wherein the latch ramp extends from the actuator portion.

4. The package of claim 1, wherein the lid ramp is formed integrally with the catch.

5. The package of claim 1, wherein the engagement of the lid ramp and the latch ramp compromises a seal formed within the package.

6. The package of claim 1, wherein the latch ramp and the lid ramp comprise mating sloped surfaces.

7. A package comprising:

a first shell portion;

a second shell portion that pivotally couples to the first shell portion to move the package between an opened position and a closed position, the second shell portion having a catch;

a latch that engages the catch when the package is in the closed position, for releasably latching the first shell portion and second shell portion together, the latch having an end portion and an actuator portion, the actuator portion adapted to be displaced by a user to release the latch, allowing the package to move from the closed position to the opened position; and a button assembly, having a button that moves between a locked position that prevents displacement of the latch, and an unlocked position that permits displacement of the latch, or from the unlocked position to the locked position, allowing the package to move from the closed position to the opened position or from the open position to the closed position.

8. The package of claim 7, wherein a tab abuts the end portion of the latch when the package is in the closed position, to prevent displacement of the latch.

9. The package of claim 7, further comprising a hinge that pivotally joins the first shell portion and the second shell portion, wherein the first shell portion and the second shell portion pivot about the hinge to move between the opened position and the closed position.

10. A package comprising:

a first shell portion;

a second shell portion that pivotally couples to the first shell portion to move the package between an opened position and a closed position, the second shell portion having a catch;

a latch that engages the catch when the package is in the closed position, for releasably latching the first shell portion and second shell portion together, the latch having an end portion and an actuator portion, the actuator portion adapted to be displaced by a user to release the latch, allowing the package to move from the closed position to the opened position; and a button assembly that moves between a locked position that prevents displacement of the latch, and an unlocked position that permits displacement of the latch, allowing the package to move from the closed position to the opened position, wherein the button assembly includes a button, the tab, and a cavity, the tab positioned to be adjacent to the end portion of the latch when the button assembly is in the locked position to prevent the displacement of the latch, the button assembly configured to align the cavity with the end portion of the latch when the button assembly is in the unlocked position to allow the displacement of the latch.

11. A package comprising:

a first shell portion;

a second shell portion that pivotally couples to the first shell portion to move the package between an opened position and a closed position, the second shell portion having a catch;

a latch that engages the catch when the package is in the closed position, for releasably latching the first shell portion and second shell portion together, the latch having an end portion and an actuator portion, the actuator portion adapted to be displaced by a user to release the latch, allowing the package to move from the closed position to the opened position; and a button assembly that moves between a locked position that prevents displacement of the latch, and an unlocked position that permits displacement of the latch, allowing the package to move from the closed position to the opened position, wherein the button assembly further comprises at least one spring that biases the button assembly to the locked position.

12. A package comprising:

a first shell portion;

a second shell portion that pivotally couples to the first shell portion to move the package between an opened position and a closed position, the second shell portion having a catch;

a latch that engages the catch when the package is in the closed position, for releasably latching the first shell portion and second shell portion together, the latch having an end portion and an actuator portion, the actuator portion adapted to be displaced by a user to release the latch, allowing the package to move from the closed position to the opened position; and a button assembly that moves between a locked position that prevents displacement of the latch, and an unlocked position that permits displacement of the latch, allowing the package to move from the closed position to the opened position, wherein the button assembly comprises a slot, and the first shell portion comprises a guide that slidably engages the slot to guide the button assembly between the locked position and the unlocked position.

13. A package, comprising:

a first shell portion that forms a base of the package;

a second shell portion that forms a lid of the package, the second shell portion being movable with respect to first shell portion to move the package between an opened position and a closed position, and including first and second catches;

first and second latches associated with the first shell portion, wherein the first and second latches respectively engage the first and second catches when the package is in the closed position for releasably latching the first shell portion and the second shell portion together in the closed position;

wherein, the first and second latches each includes an actuator that is displaceable to move the first and second latches between a distended position and a depressed position, and wherein a button assembly in said second shell portion is interfaced with the first and second latches and which requires activating said button assembly simultaneously to move the first and second latches between the distended position and the depressed position which disengages the first and second latches from the first and second catches, while driving the second shell portion away from the first shell portion to move the package from the closed position to the closed position;

said second shell portion including a lid ramp, and wherein the first and second latches each include a latch ramp that engages the lid ramp to drive said second shell portion away from said first shell portion; and the lid ramp including an upper sloping surface and the latch ramp including a lower sloping surface that mates with the upper sloping surface; and wherein said button assembly moves between a locked position and an unlocked position, and wherein said button assembly blocks displacement of the first and second latches when in the locked position.

14. The package of claim 13, wherein the latch ramp moves laterally with respect to the lid ramp when the first and second latches move between the distended position and the depressed position, and the lower sloping surface translates lateral movement of the latch ramp to an upward force applied to the upper sloping surface, to force the lid ramp away from the latch ramp and move the package into the opened position.

15. The package of claim 13, wherein said button assembly comprises a tab that blocks the displacement of the first and second latches when in the locked position, and a cavity that aligns with the first and second latches when in the unlocked position, wherein the cavity receives a portion of said first and second latches when the first and second latches are in the depressed position.

16. The package of claim 13, wherein said button assembly comprises a spring that biases said button assembly to the locked position.

* * * * *